US008736643B2

(12) United States Patent
Messmer

(10) Patent No.: US 8,736,643 B2
(45) Date of Patent: May 27, 2014

(54) METHODS AND SYSTEMS FOR REDUCING POWER CONSUMPTION IN DUAL MODULATION DISPLAYS

(75) Inventor: Neil W. Messmer, Langley (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 142 days.

(21) Appl. No.: 13/578,251

(22) PCT Filed: Feb. 15, 2011

(86) PCT No.: PCT/US2011/024868

§ 371 (c)(1),
(2), (4) Date: Aug. 10, 2012

(87) PCT Pub. No.: WO2011/103083

PCT Pub. Date: Aug. 25, 2011

(65) Prior Publication Data

US 2012/0306943 A1 Dec. 6, 2012

Related U.S. Application Data

(60) Provisional application No. 61/306,767, filed on Feb. 22, 2010.

(51) Int. Cl.
*G09G 3/36* (2006.01)

(52) U.S. Cl.
USPC ..... 345/690; 345/102

(58) Field of Classification Search
CPC ..... G09G 5/10
USPC ..... 345/690
See application file for complete search history.

(56) References Cited

U.S. PATENT DOCUMENTS

| | | | | |
|---|---|---|---|---|
| 6,559,826 | B1 * | 5/2003 | Mendelson et al. | 345/102 |
| 6,891,672 | B2 | 5/2005 | Whitehead et al. | |
| 7,370,979 | B2 * | 5/2008 | Whitehead et al. | 353/85 |
| 7,403,332 | B2 | 7/2008 | Whitehead et al. | |
| 8,217,970 | B2 | 7/2012 | Whitehead et al. | |

(Continued)

FOREIGN PATENT DOCUMENTS

| | | |
|---|---|---|
| EP | 1950731 | 7/2008 |
| WO | 02/069030 | 9/2002 |

(Continued)

OTHER PUBLICATIONS

Philip E Mattison, "Practical Digital Video with Programming Examples in C" Video Image Processing Techniques—Filtering (Chapter 9), Wiley, 1994.

*Primary Examiner* — Van Chow

(57) ABSTRACT

A control system for a dual modulation display comprises an input configured to receive image data specifying a desired image at an initial resolution, a downsampler configured to downsample the image data into a plurality of downsample blocks and obtain one or more image values for each downsample block, a backlight processing pipeline which determines driving levels for light emitters based on the image values, a lightfield simulator which receives data about the driving levels and generates a backlight illumination pattern, a front modulator processing pipeline which receives the image data and the backlight illumination pattern and determines control levels for light transmission elements of the front modulator, and, an image value adjuster which receives the image values and reduces image values of downsample blocks which meet adjustment criteria before providing the image values to the backlight processing pipeline.

9 Claims, 17 Drawing Sheets

(56) References Cited

U.S. PATENT DOCUMENTS

| | | | | |
|---|---|---|---|---|
| 2001/0035853 | A1* | 11/2001 | Hoelen et al. | 345/102 |
| 2005/0248520 | A1 | 11/2005 | Feng | |
| 2006/0103621 | A1 | 5/2006 | Feng | |
| 2007/0152954 | A1 | 7/2007 | Daly | |
| 2008/0129677 | A1 | 6/2008 | Li et al. | |
| 2009/0079768 | A1 | 3/2009 | Huang | |
| 2009/0174638 | A1 | 7/2009 | Brown Elliott et al. | |
| 2009/0184904 | A1 | 7/2009 | S. et al. | |
| 2009/0207193 | A1 | 8/2009 | Isobe et al. | |
| 2011/0175949 | A1 | 7/2011 | Wallener et al. | |
| 2012/0075360 | A1 | 3/2012 | Messmer | |
| 2012/0081387 | A1 | 4/2012 | Messmer | |
| 2012/0092395 | A1 | 4/2012 | Seetzen | |

FOREIGN PATENT DOCUMENTS

| | | |
|---|---|---|
| WO | 03/077013 | 9/2003 |
| WO | 2005/107237 | 11/2005 |
| WO | 2006/010244 | 2/2006 |
| WO | 2006066380 | 6/2006 |
| WO | 2008/092276 | 8/2008 |
| WO | 2008/094153 | 8/2008 |
| WO | 2009/004574 | 1/2009 |
| WO | 2009/086742 | 7/2009 |
| WO | 2009/089211 | 7/2009 |

* cited by examiner

METHODS AND SYSTEMS FOR REDUCING POWER CONSUMPTION IN DUAL MODULATION DISPLAYS

CROSS-REFERENCE TO RELATED APPLICATIONS

This application claims priority to U.S. Provisional Patent Application No. 61/306,767 filed 22 Feb. 2010, which is hereby incorporated by reference in its entirety.

TECHNICAL FIELD

The invention relates to dual modulation displays of the type having a backlight which illuminates a front modulator. Certain embodiments provide a reduction in power consumption of the backlight.

BACKGROUND

Displays having a plurality of light sources such as, for example, dual modulation displays wherein a controllable backlight illuminates front modulator can consume relatively large amounts of electrical power, particularly when displaying bright images. In some situations, dual modulation displays with LED backlights can require up to 500 W to 1 kW of power or more.

The inventor has determined a need for improved systems and methods for reducing power consumption in dual modulation displays.

SUMMARY OF THE INVENTION

One aspect of the invention provides a control system for a display comprising a backlight having a plurality of individually controllable light emitters configured to project light onto a front modulator having a plurality of individually controllable light transmission elements. The control system comprises an input configured to receive image data specifying a desired image at an initial resolution, a downsampler configured to downsample the image data into a plurality of downsample blocks at a downsample spatial resolution lower than the initial spatial resolution and obtain one or more image values for each downsample block, a backlight processing pipeline configured to determine driving levels for the light emitters of the backlight based on the image values for the downsample blocks, a lightfield simulator configured to receive backlight driving data about the driving levels and to transform the backlight driving data into a backlight illumination pattern, a front modulator processing pipeline configured to receive the image data from the input and the backlight illumination pattern from the lightfield simulator and to determine control levels for the light transmission elements of the front modulator, and, an image value adjuster configured to receive the image values for the downsample blocks from the downsampler and reduce image values of downsample blocks which meet adjustment criteria before providing the image values to the backlight processing pipeline.

Another aspect of the invention provides a method of reducing power consumption in a display comprising a backlight having a plurality of individually controllable light emitters configured to project light onto a front modulator having a plurality of individually controllable light transmission elements. The method comprises receiving image data specifying a plurality of pixel values at an initial spatial resolution, downsampling the image data into a plurality of downsample blocks at a downsample spatial resolution lower than the initial spatial resolution, determining a peak value and an average value for each downsample block, reducing the average values of downsample blocks having peak values below an upper watermark and average values above a lower water mark, and, providing the peak and average values of the downsample blocks to a backlight processing pipeline configured to drive the individually controllable light emitters based on the peak and average values.

Further aspects of the invention and features of specific embodiments of the invention are described below.

BRIEF DESCRIPTION OF THE DRAWINGS

The accompanying drawings illustrate non-limiting example embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The invention may be applied to provide improvements in power efficiency for displays having modulatable backlights which project light through a front modulator towards a viewing area. Certain aspects of the invention may be combined with or incorporated into other power management systems and methods such as, for example, embodiments such as those described in U.S. Patent Application No. 61/101,448 filed on 30 Sep. 2008 and PCT Patent Application No. PCT/US2009/056958 filed on 15 Sep. 2009, both of which are hereby incorporated by reference herein. Some embodiments may provide an increased dynamic contrast ratio in a display while maintaining the overall brightness of the display.

Figure 1:
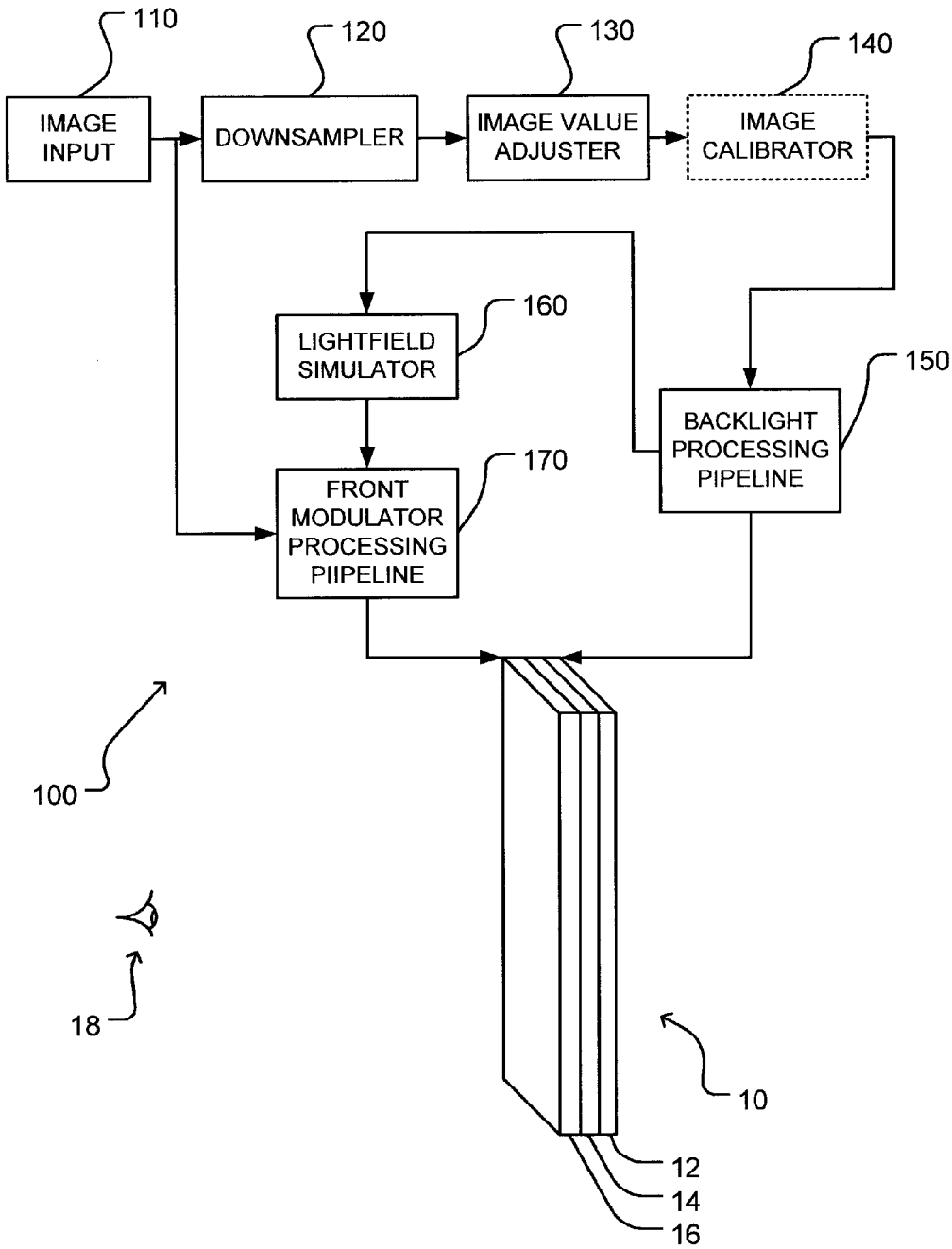
FIG. 1 is a block diagram of a dual modulation display and a control system therefor according to one embodiment.

FIG. 1 shows an example control system 100 according to one embodiment for controlling a dual modulation display 10 to display an image. Control system 100 may, for example, be incorporated into a television, computer monitor, electronic picture frame, digital cinema display, medical imaging device, or other device having a display for reproducing video or still images.

Display 10 comprises a backlight 12 having a plurality of controllable light emitters which project light onto a front modulator 16. Light from backlight 12 passes through an optics layer 14 before forming a pattern of light on front modulator 16. Front modulator 16 comprises a plurality of individually controllable light transmission elements (e.g. pixels) which may each be controlled to select an amount of transmissivity. Observers at a viewing location 18 are presented with an image produced by a pattern of light from backlight 12 which approximates the image and which has been refined by front modulator 16.

Backlight 12 may comprise, for example, an array of light emitting diodes (LEDs). In other embodiments, backlight 12 may comprise Organic LEDs (OLEDs), electroluminescent elements, or other light emitters.

Optics layer 14 may comprise, for example, one or more of a gap, a diffuser, a collimator, one or more brightness enhancement films, one or more waveguides, or other optical elements.

Front modulator 16 may comprise, for example a liquid crystal display (LCD). In other embodiments, front modulator 16 may comprise a different type of modulator having individually controllable elements (i.e. pixels) with variable transmissivities.

In some embodiments, the light emitters of backlight 12 are arranged in a two-dimensional array generally coextensive with the viewing area of display 10, and are configured to project light directly towards front modulator 16. In other embodiments, the light emitters of backlight 12 are arranged around the edges of display 10, and backlight 12 comprises additional optical elements to selectively redirect light from the light emitters toward front modulator 16.

In some embodiments, the light emitters of backlight 12 all emit light of the same, or approximately the same, spectral composition. For example, in some embodiments the light emitters may comprise white LEDs or another color of LEDs. In such embodiments, the light emitters of backlight 12 may be controlled based on an effective luminance pattern which may be derived from the image data by any of a number of techniques well known to those skilled in the art.

In some embodiments, the light emitters of backlight 12 emit light of different spectral compositions. For example, in some embodiments the light emitters may comprise red, green and blue LEDs, or other combinations of differently colored LEDs. In such embodiments, each color of light emitters of backlight 12 may be controlled based on an effective luminance pattern for that respective color, which may be derived from the image data by any of a number of techniques well known to those skilled in the art.

Display 10 may, for example, have an architecture such as those described in any of the following:

U.S. Pat. No. 6,891,672 issued 10 May 2005 and entitled High Dynamic Range Display Devices, U.S. Pat. No. 7,403,332 issued 22 Jul. 2008 and Entitled High Dynamic Range Display Devices, United States Patent publication No. 2008/0180466 published 31 Jul. 2008 and entitled "Rapid Image Rendering on Dual-modulator Displays", PCT Publication No. WO 2002/069030 published 6 Sep. 2002 and entitled "High Dynamic Range Display Devices";

PCT Publication No. WO 2003/077013 published 18 Sep. 2003 and entitled "High Dynamic Range Display Devices";

PCT Publication No. WO 2005/107237 published 10 Nov. 2005 and entitled "Method for Efficient Computation of Image Frames for Dual Modulation Display Systems Using Key Frames";

PCT Publication No. WO 2006/010244 published 2 Feb. 2006 and entitled "Rapid Image Rendering on Dual-Modulator Displays".

PCT Publication No. WO 2006/066380 published 29 Jun. 2006 and Entitled "Wide Color Gamut Displays";

PCT Publication No. WO 2008/092276 published 7 Aug. 2008 and entitled "Calibration of Displays Having Spatially-Variable Backlight"; and U.S. Provisional Patent Application No. 61/223,675 filed 7 Jul. 2009 and entitled "Edge-Lit Local Dimming Display, Display Components and Related Methods", all of which are hereby incorporated herein by reference in their entireties for all purposes.

Control system 100 comprises an image input 110 for receiving data specifying an image to be displayed on display 10. Image input 110 may, for example, be coupled to an antenna, cable, satellite, DVR, DVD, computer network, internet, etc. Image input 110 may optionally comprise gamma correction elements or other circuit elements or processing elements for pre-processing received image data.

Image data from image input 110 is provided to a downsampler 120 and a front modulator processing pipeline 170. Image data specifies a desired image by providing values indicating certain predefined characteristics for a plurality of pixels of the image. For example, in some embodiments the image data may specify the desired image in any suitable format which allows pixel brightness and color values to be displayed to be derived therefrom. For example, the format of the image data may use a "RGB color space" by providing a red (R), green (G) and blue (B) values for each pixel. In other embodiments, different color spaces may be used to specify the desired image such as, for example, YUV, YCbCr, xvYCC, or other color spaces.

Downsampler 120 converts the image data from an initial resolution to a lower resolution. Downsampler 120 obtains one or more image values for each of a plurality of downsample blocks. In embodiments wherein backlight 12 has light emitters of the same color, the image values may comprise, for example, representative values such as an average luminance value and a maximum or "peak" luminance value for the pixels corresponding to each downsample block. In embodiments wherein backlight 12 has different colors of light emitters, the image values may comprise an average and a peak value for each of a plurality of colors, each color corresponding to one of the colors of the light emitters of backlight 12.

Image values may also comprise other values representative of the set of pixels corresponding to each downsample block.

The image values may comprise, for example, a central tendency indication of image brightness for pixels of the image corresponding to a downsample block. A central tendency indication of image brightness is an indication of the intensity of illumination required to be provided to a light modulator to make the bulk of a set of pixels to appear as specified by image data. A central tendency indication of image brightness may comprise, for example, a central tendency statistic of the brightness of a set of pixels. For example, a central tendency indication of image brightness may comprise, for a set of pixels, an arithmetic mean, a median luminance, or a quantile of the brightness of the pixels. Other example central tendency indications of image brightness may comprise, for example, for a set of pixels, a truncated arithmetic mean, a geometric mean, a truncated geometric mean, a discretized mean, or an arithmetic or geometric weighted mean of the brightness of the pixels. In some embodiments, a central tendency indication of image brightness comprises a measure of the number of pixels whose brightness is greater than a threshold value. In other embodiments, a central tendency indication comprises a sum of numerical representations of the brightness of pixels, for example, a sum of the brightness components of image data specifying the pixels.

Image values from downsampler 120 are passed through an image value adjuster 130, as described further below. The output of image value adjuster 130 is provided to a backlight processing pipeline 150 for determining driving levels for the light emitters of backlight 12.

In some embodiments, the output of image value adjuster 130 is optionally processed by an image calibrator 140 before being provided to backlight processing pipeline 150. In embodiments where downsampler 120 downsamples the image data to a resolution which is higher than the resolution of the backlight, image calibrator 140 may include one or more additional downsampling stages configured to downsample the outputs of image value adjuster 130 into a resolution of the light emitters of the backlight, a resolution of groups of light emitters of the backlight (for example, in situations where the backlight has an array of RGB groups of light emitters), or into another resolution selected to be suitable for processing by backlight processing pipeline 150.

Image calibrator 140 may include processing elements configured to apply, for example, color calibration, filtration, small bright feature compensation, large-scale feature detection, or other transformations to the output of image value adjuster 130 in some embodiments. In other embodiments, one or more of such processing elements may be incorporated into image value adjuster 130 and/or backlight processing pipeline 150, or may be omitted if not required. In some embodiments image calibrator 140 and/or backlight processing pipeline apply filtering techniques such as, for example, those described in Philip E. Mattison, "Practical Digital Video with Programming examples in C", "Video Image Processing Techiniques—Filtering (chapter 9)", Wiley, 1994, which is hereby incoproated by reference herein. In some embodiments image calibrator 140 and/or backlight processing pipeline include processing elements configured to implement image display techniques based on multiple brightness indicators such as, for example, those described in U.S. Provisional Patent Application No. 61/227,652 filed 22 Jul. 2009 and entitled: IMAGE DISPLAY BASED ON MULTIPLE BRIGHTNESS INDICATORS and/or to implement drive signal control techniques such as, for example, those described in U.S. Provisional Patent Application No. 61/225,195 filed 13 Jul. 2009 and entitled: SYSTEMS AND METHOS FOR CONTROLLING DRIVE SIGNALS IN SPATIAL LIGHT MODULATOR DISPLAYS, both of which are hereby incorporated by reference herein.

Backlight processing pipeline 150 drives the light emitters of backlight 12 to project a pattern of light onto front modulator 16. The light emitters may be driven individually or in groups to project a non-uniform distribution of luminance onto front modulator 16. Backlight processing pipeline 150 also provides information about the driving levels for the light emitters to a lightfield simulator 160. Lightfield simulator 160 is configured to determine a backlight pattern based on the information about the driving levels for the light emitters. Lightfield simulator 160 may, for example, determine the backlight pattern by estimation based on the driving levels of the light emitters, the point spread functions of the light emitters, and characteristics of optical layer 14. The backlight pattern may, for example, specify a luminance of light incident on each pixel of front modulators 16, or on specific locations of front modulator 16, or on specific locations of front modulator 16 from which luminance for each pixel of from modulator 16 may be interpolated. Front modulator processing pipeline 170 uses the image data in combination with information about the backlight pattern received from lightfield simulator 160 to control front modulator 16 to selectively modulate light from backlight 12 to reproduce the image specified by image data.

Backlight processing pipeline 150 is configured to determine the driving level of each of the light emitters of backlight 12 based on information about pixels of the image which are within a region of the image corresponding to that light emitter. In some embodiments, a particular pixel of an image may be considered to correspond to a light emitter if that pixel is illuminated by at least some non-minimal amount by that light emitter. Backlight processing pipeline 150 may determine driving levels using any of a number of known techniques. In some embodiments, backlight processing pipeline 150 determines the driving level of each of the light emitters of backlight 12 based on, for example, a minimum pixel value, a maximum pixel value, and an average pixel value for pixels of the image which are within one or more regions corresponding to that light emitter as described, for example, in U.S. Patent Application No. 61/101,448 filed on 30 Sep. 2008 and PCT Patent Application No. PCT/US2009/056958 filed on 15 Sep. 2009.

Image value adjuster 130 is configured to adjust image values provided as inputs to backlight processing pipeline 150 for selected portions of the image, as described below. The resulting driving signals for the light emitters produced may be relatively stable in some embodiments since image value adjuster 130 is positioned early in the control path for backlight 12. In some embodiments, image value adjuster 130 is positioned upstream of filtering elements such that the adjusted image values output by image value adjuster may be filtered (for example, by a low-pass spatial filter such as a 9×9 FIR filter) to improve the backlight stability. In some embodiments, image value adjuster 130 is configured to reduce average pixel values (or other representative values) for selected blocks of image data, and provide the reduced average pixel values as outputs for downstream processing by backlight processing pipeline 150 so as to reduce the overall power consumption of backlight 12 of display 10. Image value adjuster 130 may also optionally provide other image values (such as, for example, adjusted or unadjusted peak values) for blocks of image data, depending on the downstream processing requirements.

Figure 2:
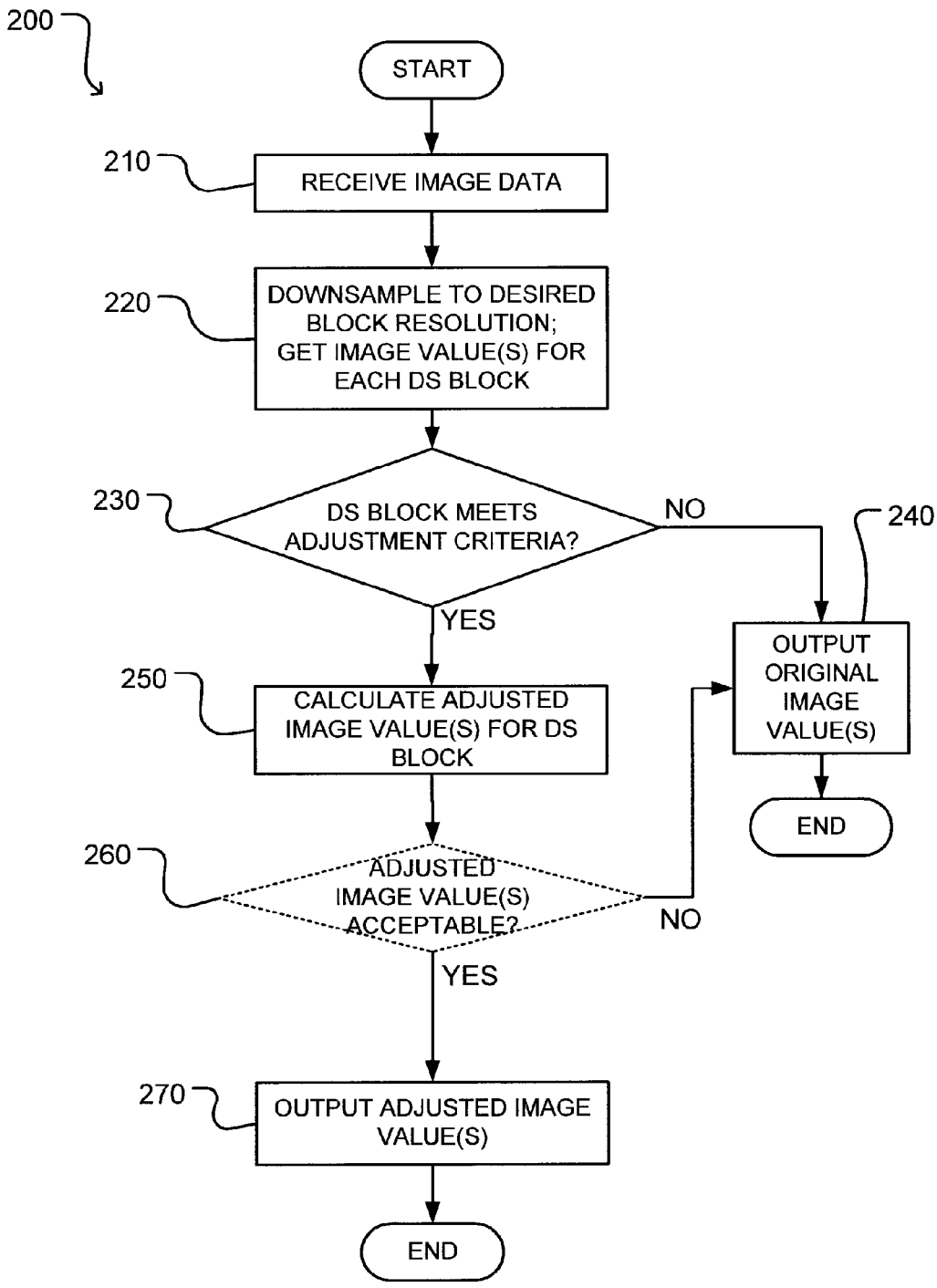
FIGS. 2, 2A, 2B, 2C, 2D, 2E and 2F are flowcharts showing methods of reducing power consumption of a display according to various embodiments.

FIG. 2 shows an example method 200 which may be implemented in a control system of a display having a plurality of light emitters which are driven based on, at least in part, peak and average pixel values for corresponding image regions. Methods 200 may, for example, be implemented by downsampler 120 and image value adjuster 130 in control system 100 of FIG. 1.

At block 210, image data is received. The received image data may have an initial resolution which is the same as that of the display on which the image is to be shown, or may have a higher or lower resolution.

At block 220, the image data is downsampled from the initial resolution into a lower resolution. In some embodiments, the resolution of the downsample blocks may be equal, or approximately equal, to the resolution of the light emitters of the backlight. In other embodiments, the resolution of the downsample blocks may be an intermediate resolution which is higher than the resolution of the light emitters of the backlight and lower than the resolution of the controllable elements of the front modulator. For example, if the backlight has a M×N array of light emitters, the image data may be downsampled into downsample blocks having a resolution of M×N, or a higher resolution. In some embodiments the downsample blocks have a resolution of at least 1.5 times the resolution of the light emitters in each of the horizontal and vertical directions. In some embodiments, the size of the downsample blocks is selected based on downstream processing elements such as, for example, filtering elements. For example, a relatively high resolution of downsample blocks may be desired in some embodiments so that filtering techniques may be applied to the adjusted image values while maintaining high local contrast, since as the area covered by a filter increases, the resulting contrast typically decreases.

Figure 3A:
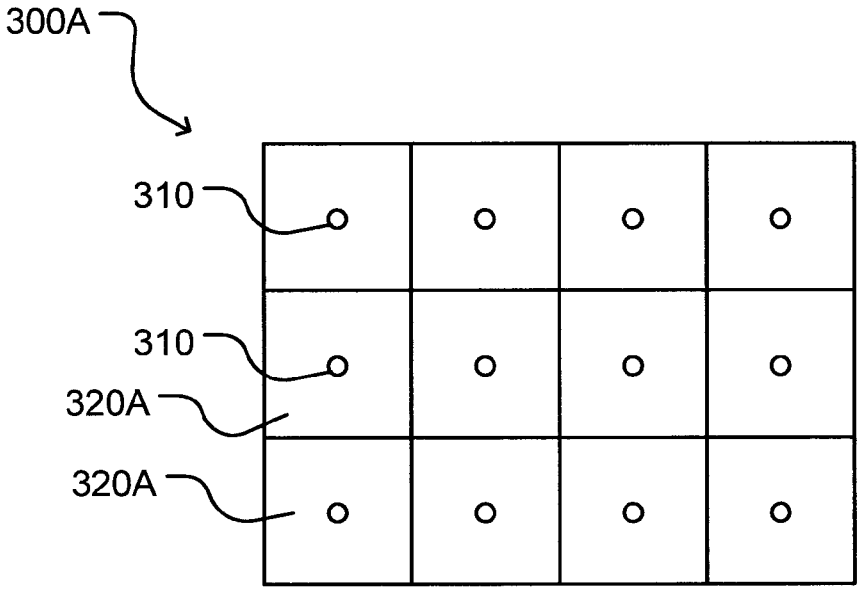
FIGS. 3A, 3B, 3C and 3D show example downsample grids.
Figure 3B:
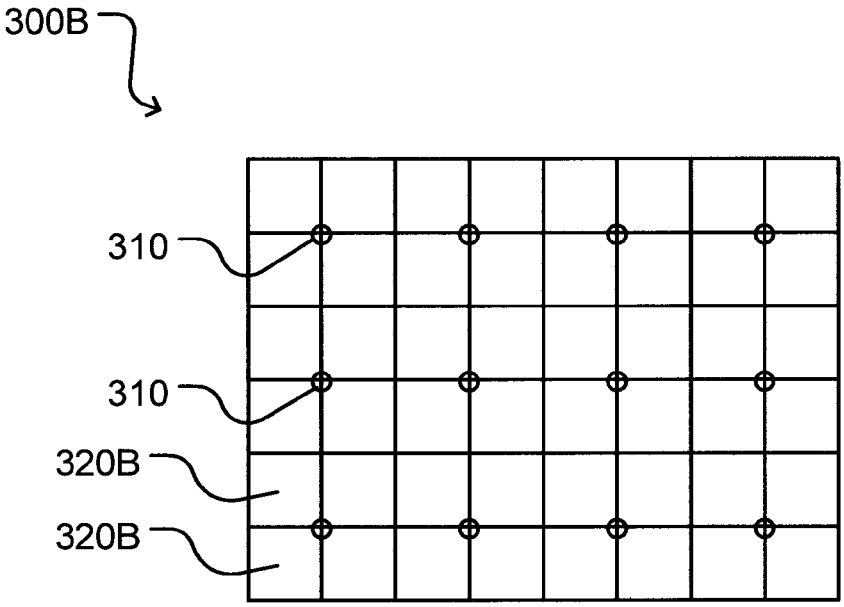
Figure 3C:
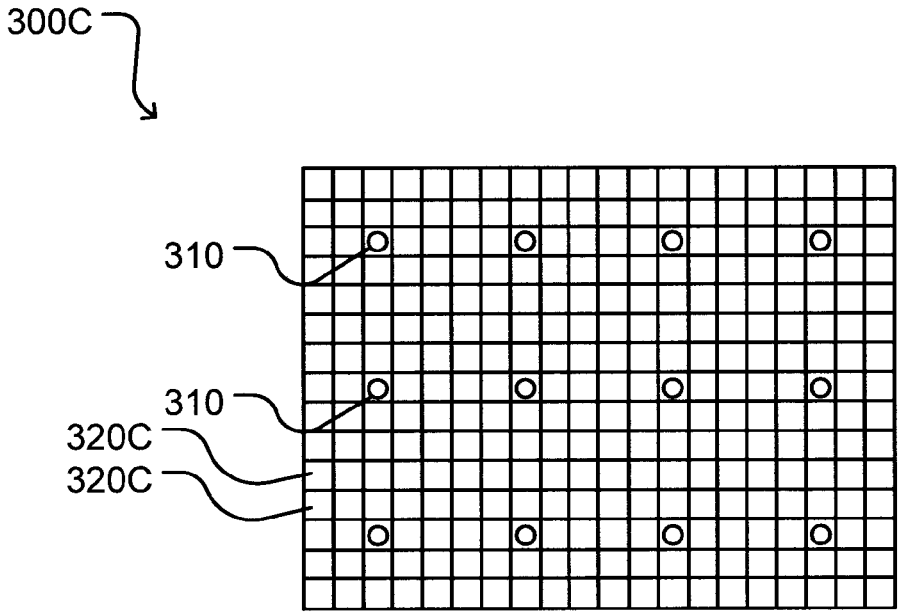
Figure 3D:
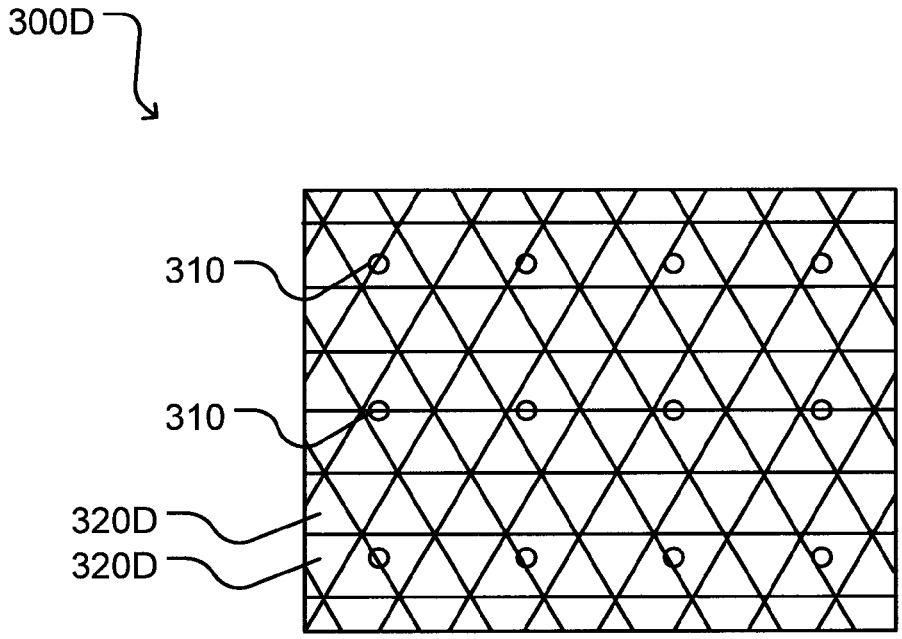

FIGS. 3A, 3B, 3C, and 3D show example downsample grids 300A, 300B, 300C, and 300D, respectively, in relation to a 3×4 rectangular array of light emitters 310. FIG. 3A shows a downsample grid 300A wherein downsample blocks 320A have a resolution equal to the resolution of light emitters 310. FIG. 3B shows a downsample grid 300B wherein downsample blocks 320B have a resolution of four times the resolution (two times the resolution in each direction) of light emitters 310. FIG. 3C shows a downsample grid 300C wherein downsample blocks 320C have a resolution of twenty-five times the resolution (five times the resolution in each direction) of light emitters 310. FIGS. 3A-C show rectangular downsample grids for a rectangular array of light emitters, but other types of grids may be employed in other embodiments. For example, hexagonal or triangular grids may be employed when the light emitters are arranged in hexagonal or triangular arrays. Also, in some embodiments, the pattern of the downsample grid may not match the pattern of the array of light emitters. For example, hexagonal or triangular grids (or other types of grids) may be employed with rectangular arrays of light emitters, or rectangular grids (or other types of grids) may be employed with hexagonal or triangular arrays of light emitters. FIG. 3D shows an example wherein a triangular downsample grid 300D having triangular blocks 320D is used for a 3×4 rectangular array of light emitters 310. In the FIG. 3D embodiment, light emitters 310 and downsample grid 300D are not symetrically aligned, such that different light emitters 310 are aligned differently with respect to blocks 320D, but it is to be understood that in other embodiments the downsample grid and the light emitters may be configured such that the light emitters are aligned with boundaries of the downsample blocks, or such that each light emitter is aligned with the center of a downsample block. In some embodiments, the characteristics of the downsample grid may be selected based on processing constraints, since smaller blocks tend to provide increased flexibility in downstream image manipulation, but may require increased processing capabilities.

For example, where the backlight comprises 1564 controllable light emitters (such as, for example, LEDs) arranged in a 46×34 array and the front modulator comprises an LCD having a resolution of 1920×1080 pixels, the downsample grid may have a resolution of 96×72 downsample blocks, with each downsample block covering an area equivalent to 20×15 pixels of the front modulator. In other embodiments, the backlight may have a smaller number of light emitters. For example, the backlight may have fewer than 1000 light emitters in some embodiments, and may have about 200 to about 500 light emitters in some embodiments Likewise, the downsample grid may have different resolutions in other embodiments, and each downsample block may cover an area equivalent to greater or less than 20×15 pixels.

Returning to FIG. 2, during the downsample process in block 220, image values used as inputs to the backlight processing pipeline are obtained for each downsample block. In some embodiments, one or more peak pixel values and one or more average pixel values are obtained for each downsample block. In other embodiments, different representative values may be obtained as image values, such as, for example percentile ranks and/or geometric means, as discussed above. In embodiments wherein the light emitters of the backlight are all the same color, single set of image values (such as, for example, a single peak and a single average) may be obtained for each block. In embodiments wherein the light emitters of the backlight are a number of (typically three or more) different colors, a set of image values may be obtained for each color for each block. Other information about the pixels of image data which may be used for downstream processing may also be obtained during the downsample process, such as, for example, a minimum pixel value for each downsample block.

At block 230, the image values of each downsample block are compared with adjustment criteria to select downsample blocks to be adjusted. In some embodiments, the adjustment criteria comprise an upper watermark. Downsample blocks having certain image values (such as, for example peak values) above the upper watermark may be excluded from having any adjustment applied thereto. Such blocks may be excluded from adjustment to ensure that elements of the front modulator corresponding to bright image areas receive sufficient light such that a desired luminance may be adequately reproduced, and to prevent saturation of pixels which may cause undesirable color shifts.

In some embodiments, the adjustment criteria comprise a lower watermark. Downsample blocks having image values (such as, for example, average values) below the lower watermark may be excluded from having any adjustment applied thereto. Such blocks may be excluded from adjustment to ensure that elements of the front modulator corresponding to dark (but not totally dark) image areas receive sufficient light such that subtle variations in the dark image areas may be adequately reproduced, and to prevent video noise which would otherwise have remained unseen from being amplified such that it becomes visually perceptible.

In some embodiments, the adjustment criteria comprise both upper and lower watermarks. Any downsample block having an image value (such as, for example, a peak value) which exceeds the upper watermark, or an image value (such as, for example, an average value) which is lower than the lower watermark may be excluded from having any adjustment applied thereto. In some embodiments, downsample blocks having image values equal to one of the watermarks may be excluded from adjustment, and in other embodiments downsample blocks having image values equal to one of the watermarks may be adjusted.

In some embodiments, the watermarks are selected based on the physical characteristics of the backlight and/or the front modulator. For example, the lower watermark may be set based on the contrast ratio of the front modulator, such that smaller values are used as lower watermarks when the front modulator has a higher contrast ratio, and greater values are used as lower watermarks when the front modulator has a lower contrast ratio. In some embodiments, the watermarks are selected during factory tuning and calibration of a display. In some embodiments, the watermarks are selected based on the overall power consumption of the display. For example, the separation between the upper and lower watermarks may be increased in some embodiments to reduce the overall power consumption of the display. In some embodiments, the watermarks are selected based on metadata accompanying the image data which provides characterizing information about the image to be displayed. In some embodiments, the watermarks are adjustable by means of software control during calibration of the display. In some embodiments, the watermarks may be adjusted in a service menu for display, or may be user-adjustable, for example, by providing a display with a plurality of display modes.

In some embodiments, the watermarks are selected to have values of $2^n-1$, where n is a positive integer, to facilitate rapid comparison of image values in binary format with the watermarks. In some embodiments, when image values are represented using N bits, the watermarks are also represented using N bits. For example, in some embodiments the upper watermark has the value $2^{N-1}-1$. In such embodiments, image values exceeding the upper watermark may be easily identified by checking whether the most significant bit of the image value is set. Similarly, the lower watermark may have the value $2^{M-1}$ (where M is a positive integer less than N−1), such that any image values at or below the lower watermark may be easily identified by checking whether any of the N−M most significant bits of the image value is set. For example, where image values are represented as 8-bit binary numbers, the upper watermark may be 10000000, and the lower watermark may be 00100000. In some embodiments, the upper watermark may be selected to have a maximum value (e.g. 11111111 for 8-bit image values) in order to maximize the power reduction achievable by adjustment of the image values.

After block 230, for downsample blocks which do not meet the adjustment criteria (block 230 NO output), method 200 proceeds to block 240. At block 240, the original (unadjusted) image values are output for further downstream processing. For downsample blocks which meet the adjustment criteria (block 230 YES output), method 200 proceeds to block 250. At block 250, one or more adjusted image values are calculated. In some embodiments, image values (such as, for example average values or other representative values) of downsample blocks which meet the adjustment criteria are reduced at block 250. In some embodiments, the average value is reduced by an amount determined based on the ratio of the peak value to the upper watermark, as described further below. In some embodiments, the image values are be reduced by dividing by $2^n$, where n is a positive integer. In some embodiments, image values may be logarithmically reduced (for example, by taking the natural logarithm of the image value, or the logarithm of the image value in some other base). Logarithmic reduction of image values may more closely match the response of the human visual system in certain situations.

After block 250, method 200 optionally proceeds to block 260, where the adjusted image values are subjected to a further check to determine if the adjusted image values are acceptable. Checking whether the adjusted image values are acceptable may comprise, for example, comparing the adjusted image values to one or more thresholds, as described further below. For example, in some embodiments a reduced average value is compared to a minimum average threshold, and any reduced average values below the minimum average threshold may be determined to be unacceptable.

In some embodiments, an increased peak value may be calculated for each reduced average value, with the increased peak value determined based on the amount by which the average value is reduced. (For example, if the reduced average value is one half the original average value, the increased peak value may be two times the original peak value). In such embodiments, the increased peak value is compared to a maximum peak threshold, and any increased peak value above the maximum peak threshold may be determined to be unacceptable. However, the increased peak value is typically only used for comparison purposes, and the original peak value is maintained as an image value for the downsample block under consideration.

The minimum average threshold may be the same as the lower watermark in some embodiments, and different from the lower watermark in other embodiments. Similarly, the maximum peak threshold may be the same as the upper watermark in some embodiments, and different from the upper watermark in other embodiments.

For backlights having one color of light emitters a single reduced image value (such as, for example an average value) may be calculated for each block which meets the adjustment criteria, and multiple reduced image values (one for each color) may be calculated for multicolor backlights. Where reduced image values are calculated for each of a plurality of colors for embodiments for use with multicolor backlights, the image values for each color may be proportionally reduced in order to preserve the chromaticity of the downsample block in some embodiments. In some embodiments for use with multicolor backlights, image values of a downsample block are only adjusted if the image values for each color meet the adjustment criteria, and none of the resulting adjusted average and peak values would be below the minimum average threshold or above the maximum peak threshold, respectively.

Figure 4A:
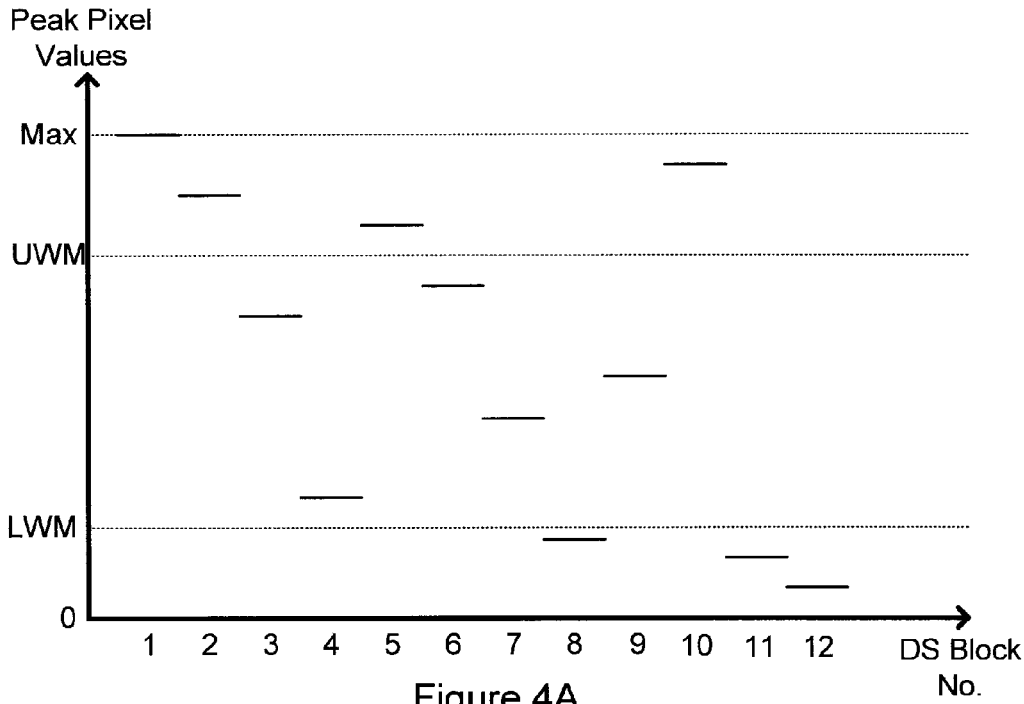
FIGS. 4A and 4B are graphs showing peak pixel values and average pixel values, respectively, for example downsample blocks.
Figure 4B:
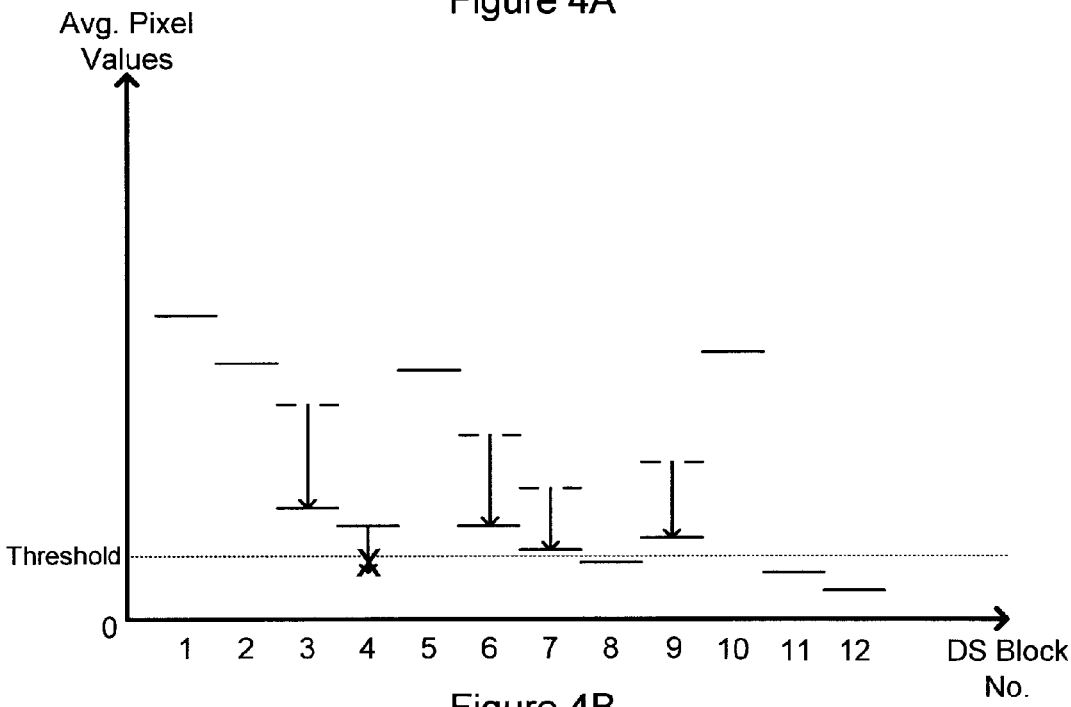

FIG. 4A shows example peak values for a group of downsample blocks, individually numbered as blocks 1-12, in an embodiment where the adjustment criteria are defined as having a peak value within an adjustment range defined between an upper watermark (UWM) and a lower watermark (LWM). Blocks 1, 2, 5 and 10 have peak values above the UWM and blocks 8, 11 and 12 have peak values below the LWM (and thus also have average values below the LWM), meaning that only blocks 3, 4, 6, 7 and 9 meet the adjustment criteria. FIG. 4B shows example average values for blocks 1-12 of FIG. 4A. The average values of blocks 1, 2, 5, 8, 10 11 and 12 are not adjusted. The average values of blocks 3, 6, 7 and 9 are adjusted, with broken lines indicating the initial average values, solid lines indicating the reduced average values, and arrows showing the reductions.

However, since adjustment of the average value of block 4 would result in a reduced average below the minimum average threshold, the average value of block 4 is not adjusted (as indicated by the arrow with the "X" therethrough in FIG. 4B). Alternatively, the average value of block 4 may be adjusted down to the minimum average threshold Likewise, in embodiments where an increased peak value is calculated and compared to a maximum peak threshold, reduction of an average value may be inhibited if a correspondingly increased peak value would be above the maximum peak threshold.

In some embodiments, reduction of the average value of a downsample block may be inhibited if the peak value is more than twice the average value. This may be done in order to allow proper display of small bright features, such as described, for example in U.S. Provisional Patent Application No. 61/227,652 filed 22 Jul. 2009 and entitled: IMAGE DISPLAY BASED ON MULTIPLE BRIGHTNESS INDICATORS.

Returning to FIG. 2, if the adjusted image values are not acceptable (block 260 NO output), method 200 proceeds to block 240, where the original image values are output for further downstream processing. If the adjusted image values are acceptable (block 260 YES output), method 200 proceeds to block 270, where the adjusted image values are output for further downstream processing. In some embodiments, block 260 may be omitted, in which case method 200 proceeds directly from block 250 to block 270. In some embodiments, method 200 may be modified to provide iterative reduction of image values, as described below with reference to FIG. 2F.

Outputting of the image values at blocks 240 and 270 may comprise providing the image values directly to the backlight processing pipeline, (or to an image calibrator in some embodiments). Alternatively, outputting of the image values at blocks 240 and 270 may comprise storing the image values in a register or other memory accessible during downstream processing.

FIGS. 2A-2F show example methods 200A-F which may be implemented in a control system of a display having a plurality of light emitters which are driven based on, at least in part, peak and average pixel values for corresponding image regions. Methods 200A-F may, for example be implemented by downsampler 120 and image value adjuster 130 in control system 100 of FIG. 1.

Methods 200A-F each begin with blocks 210, 220, 230, and 240, which correspond to the like-numbered blocks of method 200 described above. Methods 200A-F differ in how downsample blocks which meet the adjustment criteria are processed. In the examples shown in FIGS. 2A-2F, peak and average values are used as the image values for the downsample blocks, but it is to be understood that the techniques applied in methods 200A-F may also be applied to different image values. Also, in some embodiments peak values may not be required for downstream processing, in which case methods 200A-F may be modified such that only average values (or other representative values) for the downsample blocks are output.

Figure 2A:
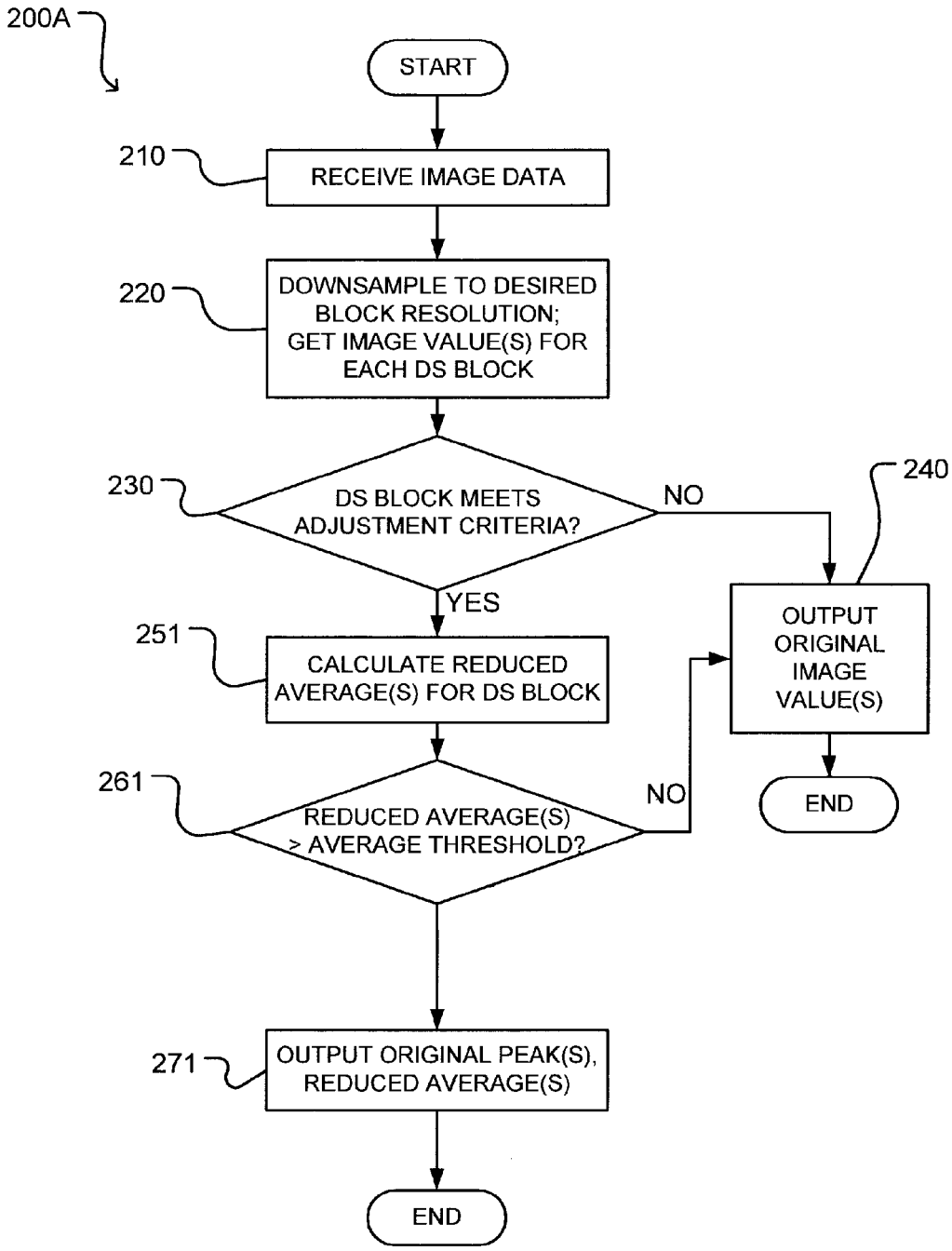

In the embodiment of FIG. 2A, if a downsample block meets the adjustment criteria (block 230 YES output), method 200A proceeds to block 251. At block 251, reduced average values for downsample blocks having peak values which meet the adjustment criteria are calculated. As discussed above, a single reduced average may be calculated when the backlight has light emitters of the same color, and multiple reduced averages may be calculated when the backlight has multicolored light emitters. After block 251, method 200A proceeds to block 261.

At block 261, the reduced average value(s) is(are) compared to a minimum average threshold. If any reduced average value is not above the theshold (block 261, NO ouptut), method 200A proceeds to block 240, and the original image values for that block are output. If the reduced average value (or all the reduced average values for each color in the case of a multicolor backlight) is above the threshold (block 261, YES ouptut), method 200A proceeds to block 271, where the original peak value(s) and reduced average value(s) are output for downstream processing by the backlight processing pipeline. In some embodiments, method 200A may be modified to provide iterative reduction of average values, as described below with reference to FIG. 2F.

Figure 2B:
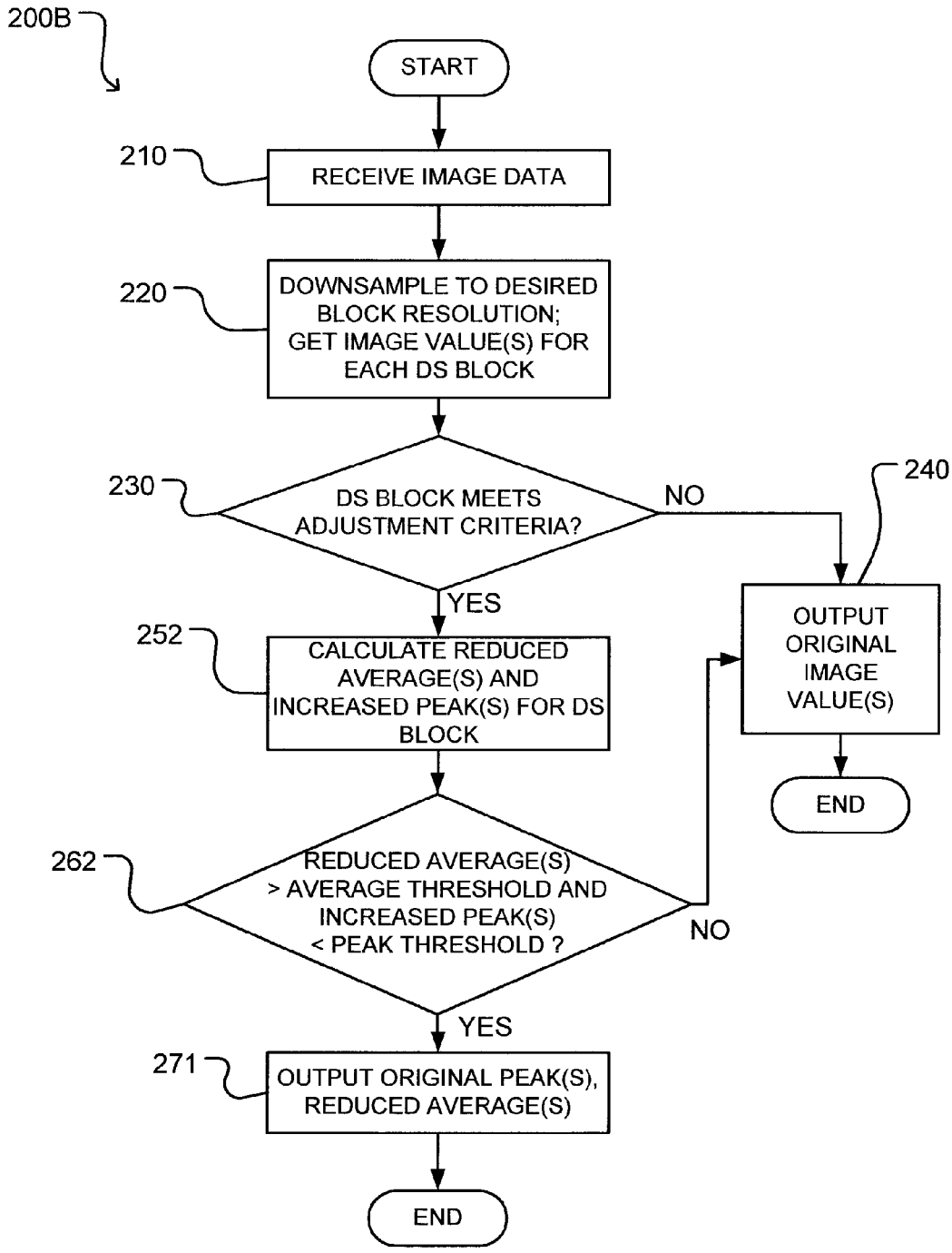

In the embodiment of FIG. 2B, if the downsample block meets the adjustment criteria (block 230 YES output), method 200B proceeds to block 252. At block 252, reduced average values and increased peak values for downsample blocks having peak values which meet the adjustment criteria are calculated. As discussed above, the increased peak values may be calculated my multiplying the original peak values by the same factor by which the average values are reduced, while preserving the original peak values. As also discussed above, a single reduced average and a single increased peak may be calculated when the backlight has light emitters of the same color, and multiple reduced averages and multiple increased peaks may be calculated when the backlight has multicolored light emitters. After block 252, method 200B proceeds to block 262.

At block 262, the reduced average value(s) is(are) compared to a minimum average threshold and the increased peak values(s) is(are) compared to a maximum peak threshold. If any reduced average value is below the minimum average threshold or any increased peak value is above the maximum peak threshold (block 262, NO ouptut), method 200B proceeds to block 240, and the original image values for that block are output. If the reduced average value (or all the reduced average values for each color in the case of a multicolor backlight) is no below the minimum average threshold, and the increased peak value (or all the increased peak values for each color in the case of a multicolor backlight) is not above the maximum peak threshold (block 262, YES ouptut), method 200B proceeds to block 271, where the original peak value(s) and reduced average value(s) are output for downstream processing by the backlight processing pipeline. In some embodiments, method 200B may be modified to provide iterative reduction of average values, as described below with reference to FIG. 2F.

Figure 2C:
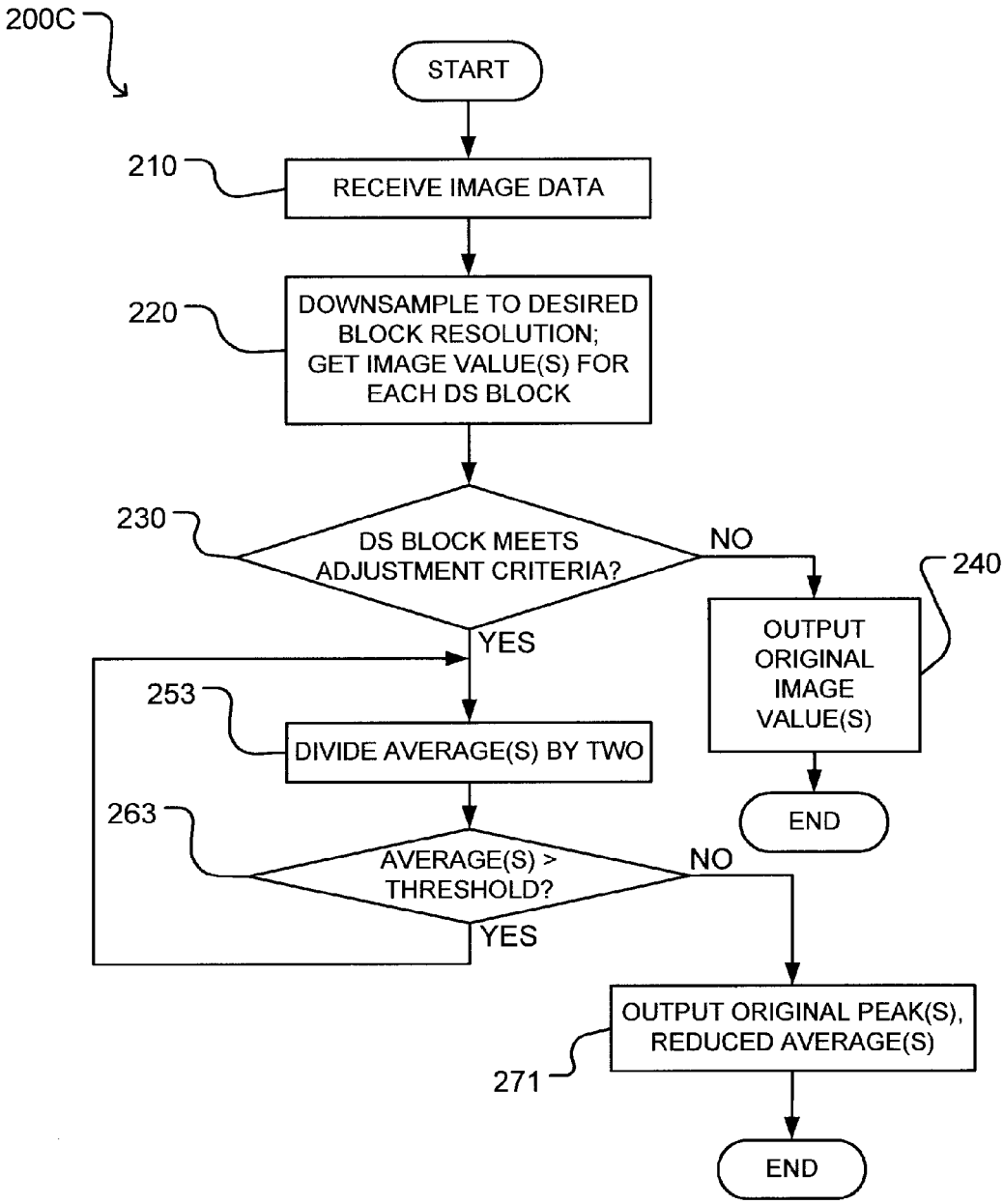

In the embodiment of FIG. 2C, if the downsample block meets the adjustment criteria (block 230 YES output), method 200C proceeds to blocks 253 and 263. At block 253, the average value(s) is(are) divided by two. At block 263, the reduced average value(s) is(are) compared to a minimum average threshold. If the reduced average value(s) is(are) above the minimum average threshold (block 263 YES output), method 200C returns to block 253 and the average value(s) is(are) divided by two again. In some embodiments, method 200C may also comprise multiplying the peak value by two at block 253 and comparing the increased peak value to a maximum peak threshold at block 263. Blocks 253 and 263 repeat until any reduced average value is below the minimum average threshold (block 263 NO output), at which point method 200C proceeds to block 271 where the peak value(s) and previous average value(s) (i.e., the reduced average value(s) above the minimum average threshold) are output for downstream processing by the backlight processing pipeline. In some embodiments, the number of times method 200C cycles through blocks 253 and 263 may be limited. For example, a counter may be incremented each time the average value(s) is(are) divided by two at block 253, and method 200C may proceed directly to block 271 once the counter reaches some predetermined count (e.g. three), such that the average values are not divided by more than some predetermined number (e.g. eight).

Figure 2D:
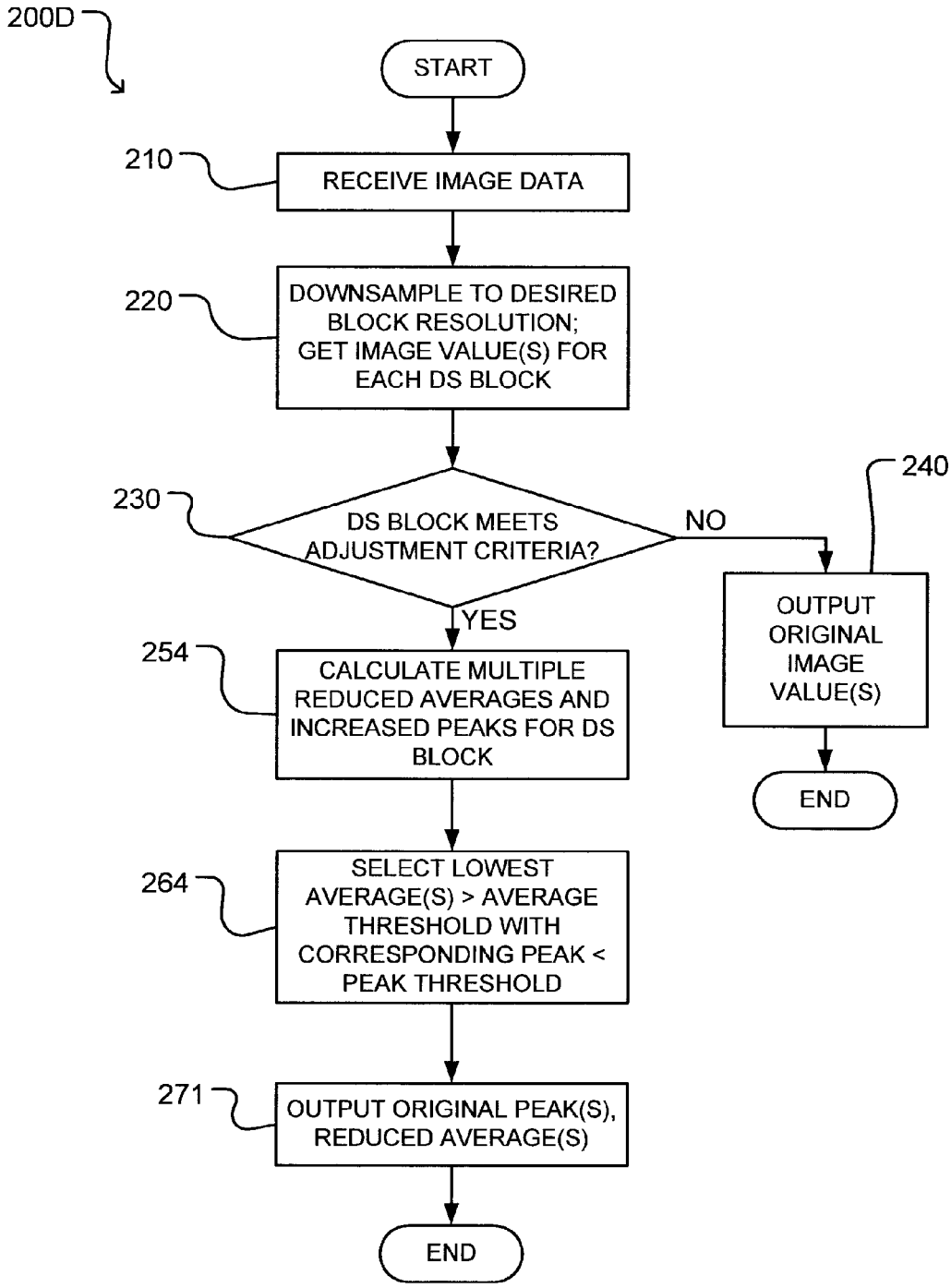

In the embodiment of FIG. 2D, if the downsample block meets the adjustment criteria (block 230 YES output), method 200D proceeds to block 254. At block 254, multiple reduced average values (or multiple sets of reduced average values in the case of a multicolor backlight) are calculated for each downsample block which meets the adjustment criteria, as well as multiple correspondingly increased peak values. At block 264, the lowest reduced average value (or set of average values) which is(are) above a minimum average threshold, and for which the corresponding increased peak value(s) is(are) below a maximum peak threshold, is selected. After block 264 method 200D proceeds to block 271 where the original peak value(s) and selected reduced average value(s) are output for downstream processing by the backlight processing pipeline.

Figure 2E:
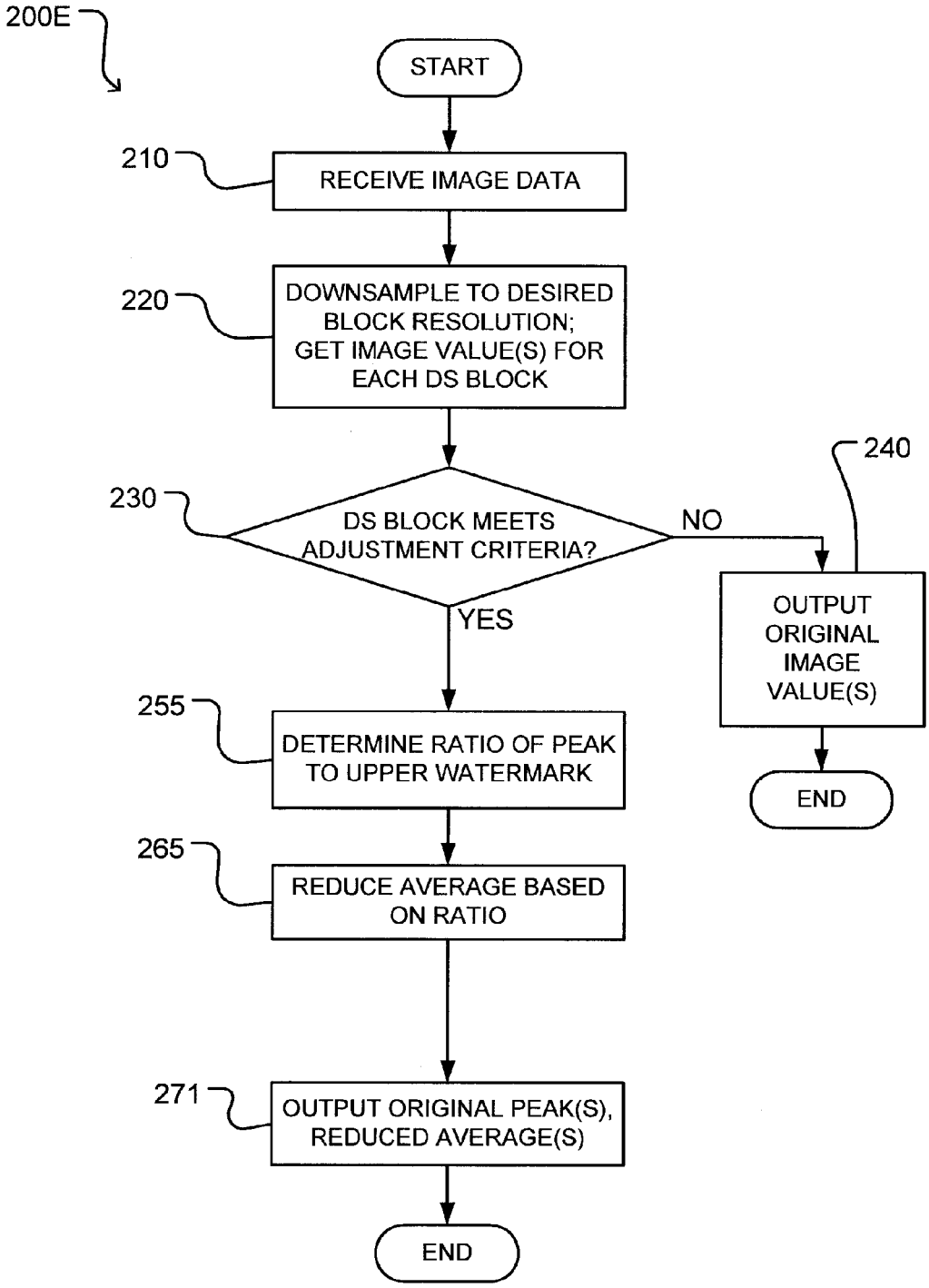

In the embodiment of FIG. 2E, if the downsample block meets the adjustment criteria (block 230 YES output), method 200E proceeds to block 255. At block 255, a ratio of the peak value to the upper watermark is determined. In embodiments for use with multicolor backlights where a peak value is provided for each color, the peak value closest to the upper watermark may be used to caluculate the ratio. At block 265 the average value(s) is(are) reduced based on the ratio determined in block 255. For example, if the peak value is 80 percent of the upper watermark, the average value may be reduced by multiplying by 0.8 at block 265 to generate a scaled reduced average. After block 265 method 200E proceeds to block 271 where the original peak value(s) and scaled reduced average value(s) are output for downstream processing by the backlight processing pipeline. In some situations, a fixed or controllable offset may be added to the scaled reduced average, depending on downstream processing requirements. Adding an offset to the scaled reduced average may avoid saturation of pixels in some situations by providing a margin for calibration.

Figure 2F:
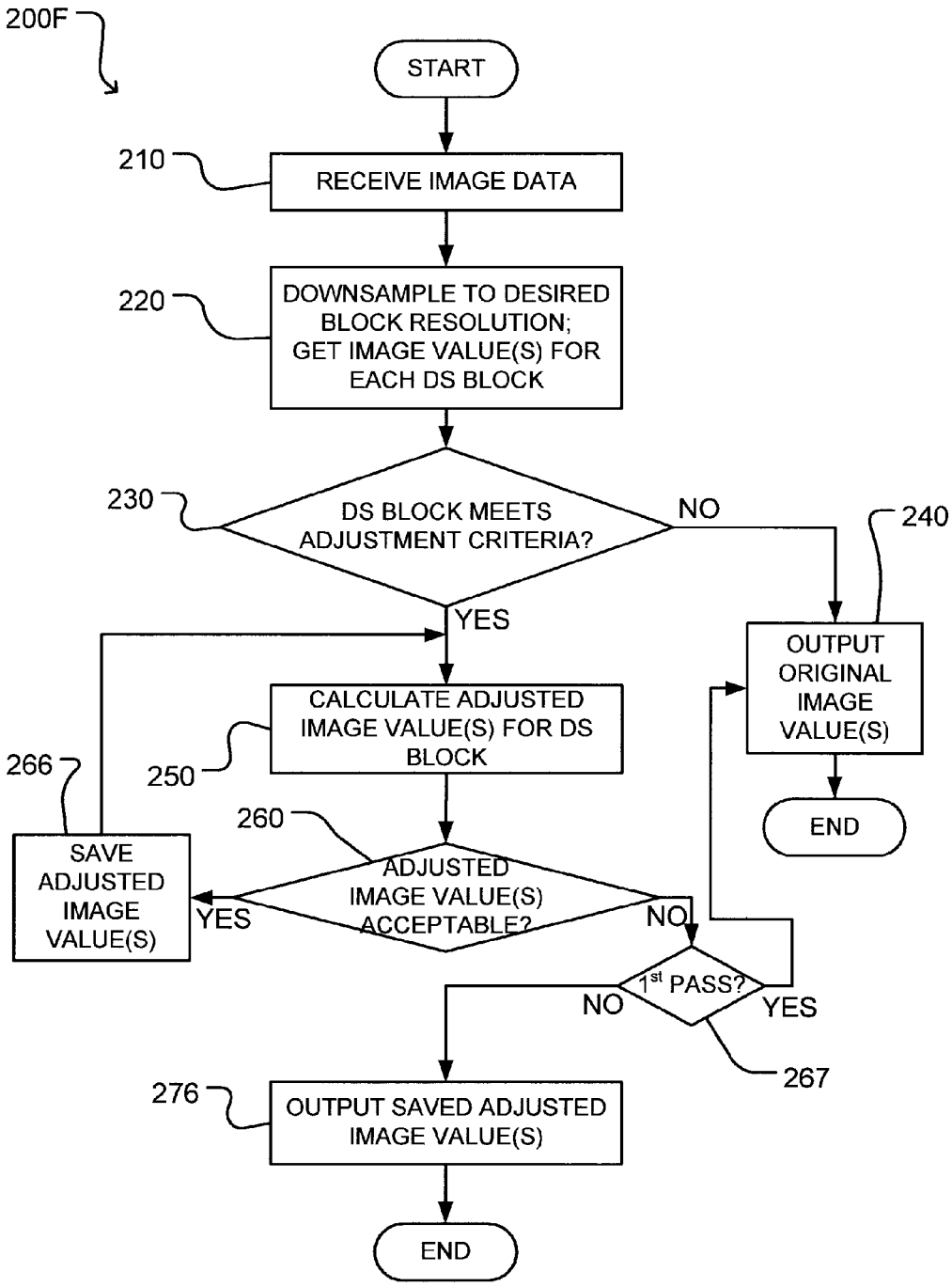

Method 200F of FIG. 2F is similar to method 200 of FIG. 2, except that in FIG. 2F the image values are iteratively adjusted. In the embodiment of FIG. 2F, after block 260, if the adjusted image value(s) is(are) acceptable (block 260 YES output), method 200F proceeds to block 266 where the adjusted image value(s) is(are) saved, then returns to block 250 to further adjust the image values. Method 200F thus cycles through blocks 250, 260 and 266 until the adjusted image value(s) is(are) no longer acceptable (block 260 NO output), at which point method 200F proceeds to block 267. At block 267 the number of passes through blocks 250 and 260 are checked. If it is the first pass (block 267 YES output), there are no acceptable adjusted image values, and method 200F proceeds to block 240 where the original image values are output. If it is the second or subsequent pass (block 267 NO output), at least one acceptable adjusted image value (or at least one set of adjusted image values) has been saved at block 266, and method 200F proceeds to block 276 to output the most recently saved acceptable image value(s). As one skilled in the art will appreciate, other methods such as, for example, methods 200A and 200B of FIGS. 2A and 2B, could also be adapted to employ an iterative technique similar to that illustrated by method 200F of FIG. 2F.

Methods according to some embodiments of the invention provide displays having reduced power requirements which are advantageously simple and have low latency. In some embodiments, power reduction methods add no latency. Power reduction methods according to some embodiments also may result in stable driving of the backlights, may be implemented using low resources, and/or may prevent pixel saturation. In some embodiments, power reduction methods also advantageously increase or maximize the contrast ratios of the displays in which they are applied.

Figure 5:
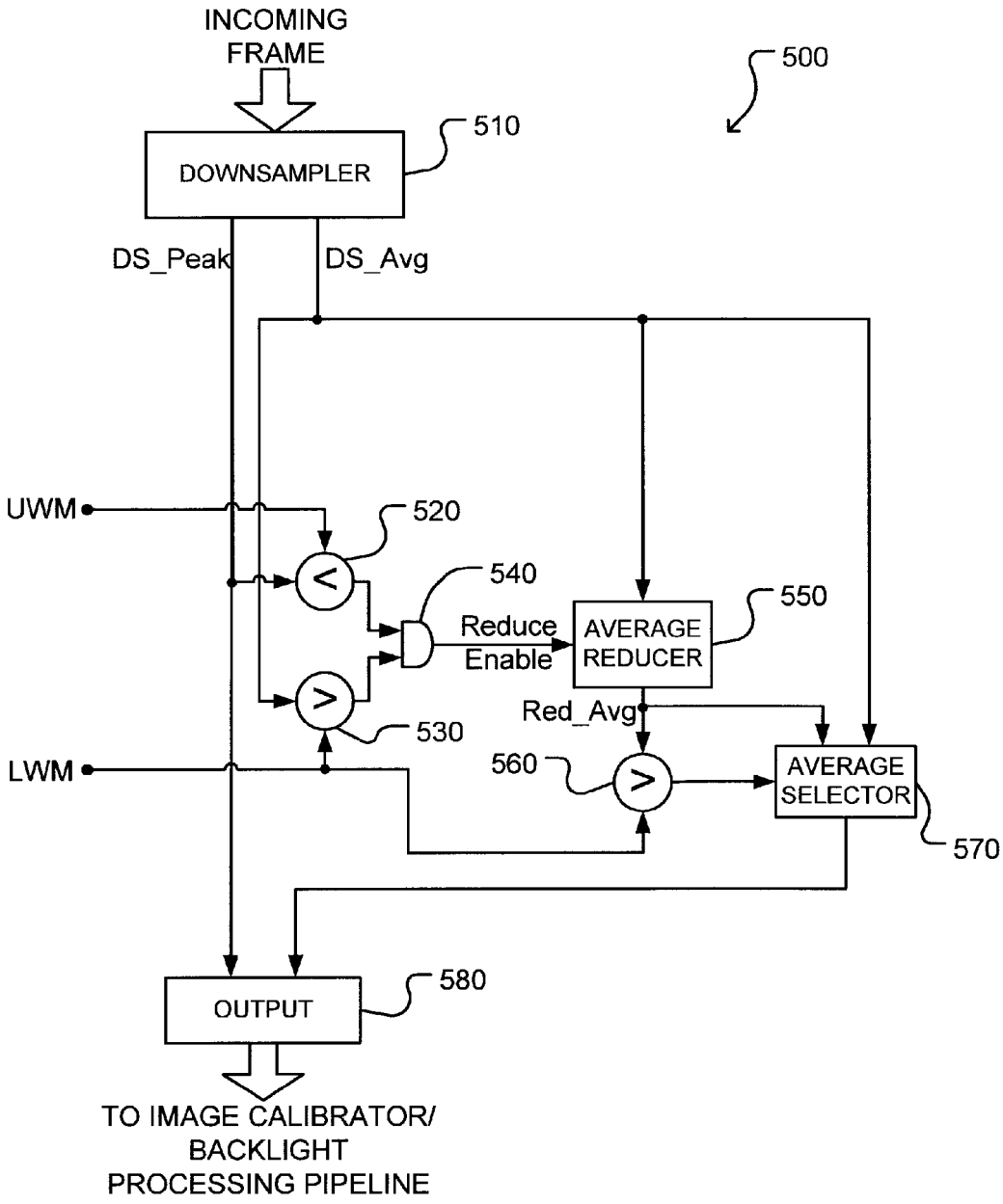
FIGS. 5, 5A, 5B, 5C, 6 and 6A are schematic circuit diagrams showing portions of a control system for reducing power consumption of a display according to various embodiments.

FIG. 5 shows an example circuit 500 according to one embodiment which may be included in a control system for a display for adjusting image values provided as inputs to a backlight processing pipeline. A downsampler 510 receives an incoming frame of image data, and outputs a peak value (DS_Peak) and an average value (DS_Avg) for each downsample block. DS_Peak is provided as an input to a comparator 520, and DS_Avg is provided as an input to a comparator 530. Comparator 520 also receives an upper watermark (UWM) as an input, and produces a high output when DS_Peak is less than UWM. Comparator 530 also receives a lower watermark (LWM) as an input, and produces a high output when DS_Avg is greater than LWM. The outputs of comparators 520 and 530 are provided to an AND gate 540, the output of which is provided as a Reduce Enable signal to an average reducer 550.

Average reducer 550 receives DS_Avg from downsampler 510, and is configured to output a reduced average (Red_Avg) when enabled. When the output of AND gate 540 is high (meaning that the outputs of comparators 520 and 530 are both high), average reducer 550 is enabled. Red_Avg is provided as an input to a comparator 560 and an average selector 570. Comparator 560 also receives LWM as an input and is configured to produce a high output when Red_Avg is greater than LWM. The ouptut of comparator 560 is provided to average selector 570. When the output of comparator 560 is high, average selector 570 provides Red_Avg to an output 580. Average selector 570 also receives DS_Avg from downsampler 510 as an input, and is configured to provide DS_Avg to output 580 when the output of comparator is not high (meaning that Red_Avg is below LWM, or there is no Red_Avg since average reducer 550 is not enabled.) Output 580 also receives DS_Peak from downsampler 510, and provides DS_Peak and either DS_Avg or Red_Avg (as determined by average selector 570) to downstream elements for further processing. In some embodiments where DS_Peak is not required for downstream processing, output 580 does not receive DS_Peak.

Figure 5A:
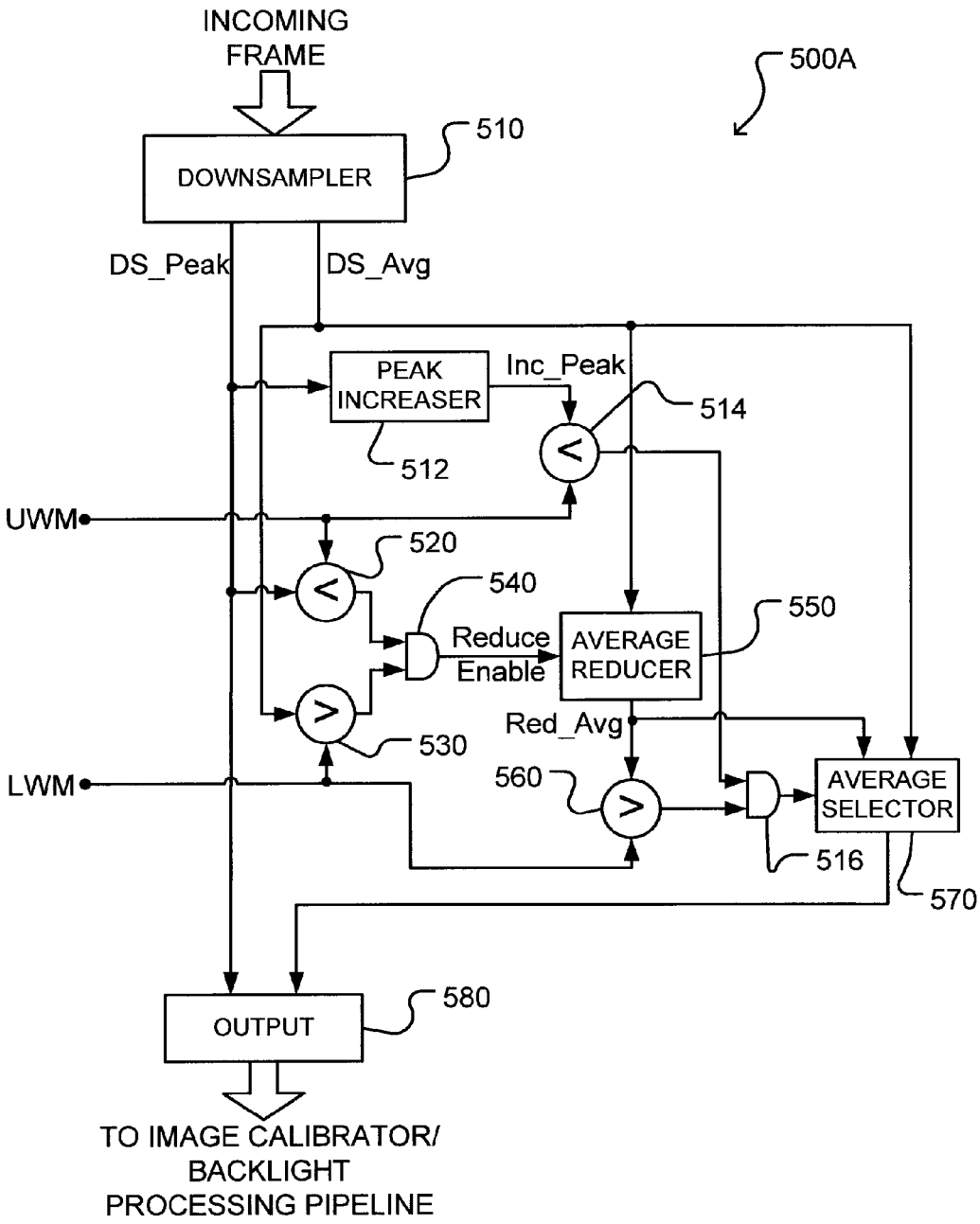

FIG. 5A shows another example circuit 500A which is similar to circuit 500 of FIG. 5. Circuit 500A differs from circuit 500 in that circuit 500A includes a peak increaser 512 which receives DS_Peak from downsampler 510. Peak increaser 512 is configured to increase DS_Peak by the same factor by which average reducer 550 reduces DS_Avg to provide a reference value Inc_Peak. The output of peak increaser 512 (Inc_Peak) is provided to a comparator 514. Comparator 514 also receives UWM as an input and is configured to produce a high output when the Inc_Peak is less than UWM. The ouptut of comparator 514 is provided as an input to an AND gate 516. AND gate 516 also receives the output of comparator 560 as an input. The output of AND gate 516 is provided to average selector 570, which is configured such that Red_Avg is only provided to output 580 when average reducer 550 is enabled, Red_Avg is above LWM and Inc_Peak is below UWM.

Figure 5B:
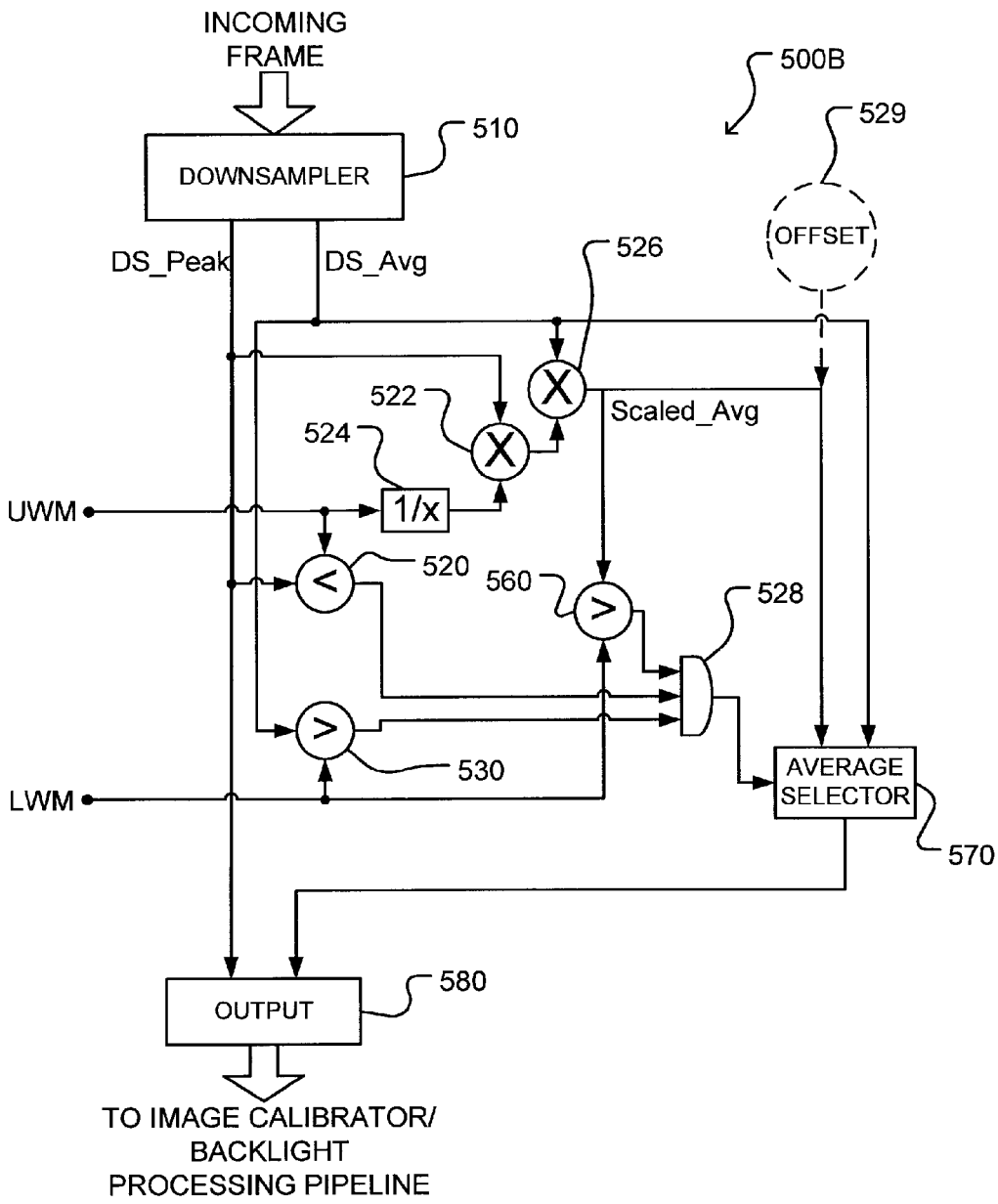

FIG. 5B shows another example circuit 500B which is similar to circuit 500 of FIG. 5. Circuit 500B differs from circuit 500 in that circuit 500B uses the ratio of DS_Peak to UWM to provide a scaled reduced average value. In circuit 500B, DS_Peak is provided as an input to a multiplier 522. UWM is provided to a processing element 524 which is configured to provide the multiplicative inverse of UWM to multiplier 522. The output of multiplier 522, which represents the ratio of DS_Peak to UWM, is provided as an input to another multiplier 526. (As one skilled in the art will appreciate, multiplier 522 and element 524 could be replaced by a divider in some embodiments.) Multiplier 526 also receives DS_Avg as an input, and multiplies DS_Avg by the ratio of DS_Peak to UWM produce an output Scaled_Avg. Scaled_Avg is provided as an input to comparator 560 and average selector 570 in place of Red_Avg. In some embodiments, a fixed or controllable offset 529 may be added to Scaled_Avg to provide a margin for calibration to reduce pixel saturation, as discussed above. The outputs of comparators 520, 530 and 560 are all provided to an AND gate 528. The output of AND gate 528 is provided to average selector 570, which is configured such that Scaled_Avg is only provided to output 580 when DS_Peak is between LWM and UWM, and Scaled_Avg is above LWM.

Figure 5C:
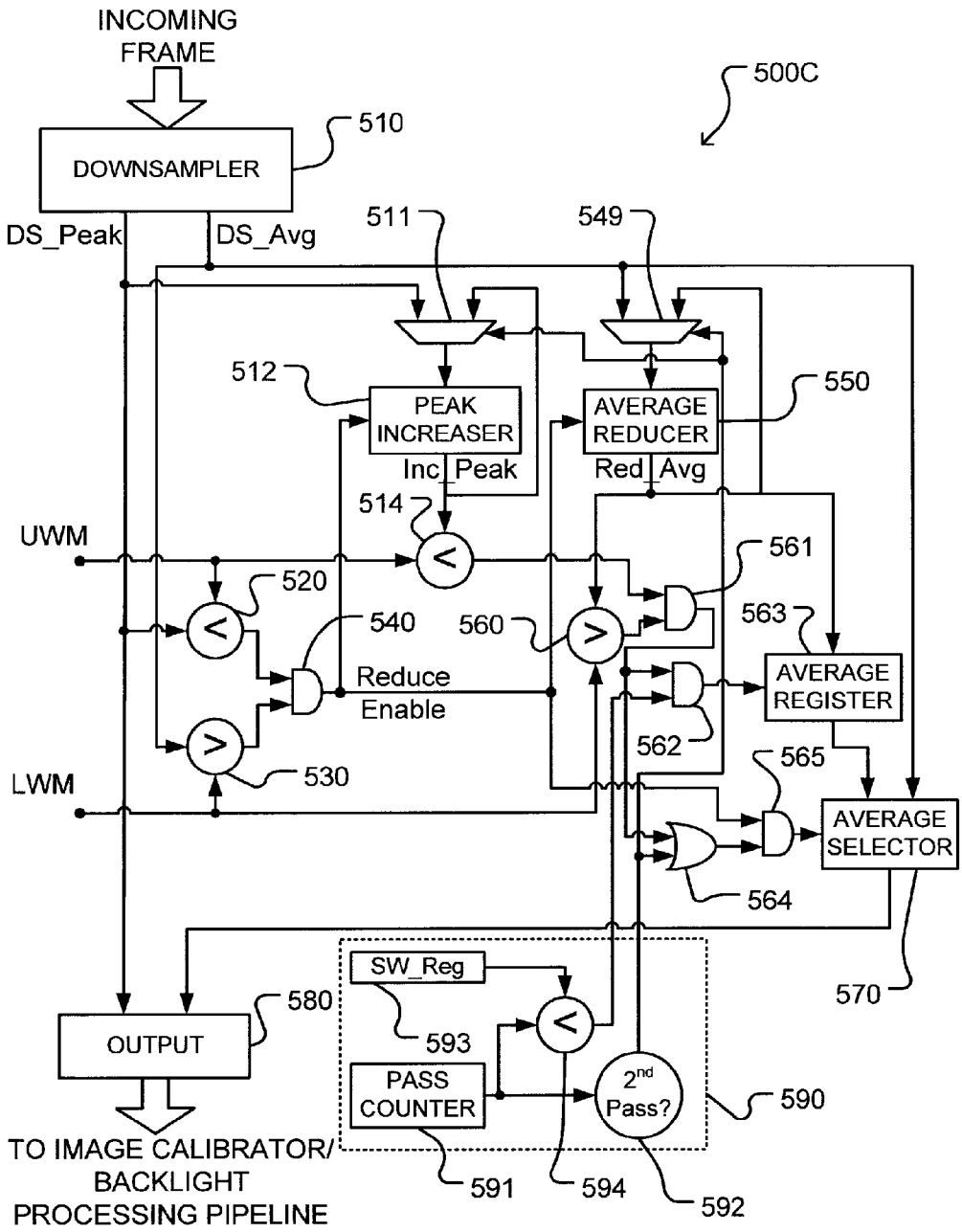

FIG. 5C shows another example circuit 500C which is similar to circuit 500A of FIG. 5A. Circuit 500C differs from circuit 500A in that circuit 500C applies an iterative technique to reducing the average values and correspondingly increasing the peak values. In circuit 500C, both peak increaser 512 and average reducer 550 receive the Reduce Enable signal, such that they are enabled when the output of AND gate 540 is high (i.e. whenever DS_Peak is below UWM and DS_Avg is above LWM). Peak increaser 512 and average reducer 550 also have multiplexers 511 and 549 connected to their respective inputs. Multiplexer 511 receives DS_Peak from downsampler 510 and Inc_Peak from peak increaser 512 as inputs, and is configured to provide one of these values as the input to peak increaser 512 under control of an iteration control block 590. Similarly, multiplexer 549 receives DS_Avg from downsampler 510 and Red_Avg from average reducer 550 as inputs, and is configured to provide one of these values as the input to average reducer 550 under control of an iteration control block 590.

Iteration control block 590 comprises a pass counter 591 configured to cont the number of passes of the peak and average values through peak increaser 512 and average reducer 550. The output of pass counter 591 is provided to a 2nd pass block 592, which is configured to have a low output on the first pass, and a high output on the second and subsequent passes. The output of 2nd pass block 592 is provided to multiplexers 511 and 549, which are configured such that DS_Peak and DS_Avg are respectively provided to the inputs of peak increaser 512 and average reducer 550 on the first pass, and Inc_Peak and Red_Avg are respectively provided to the inputs of peak increaser 512 and average reducer 550 on the second and subsequent passes.

Iteration control block 590 also comprises a comparator 594 and a software controlled register 593. Software controlled register 593 is configured to output a maximum iteration count. In other embodiments, software controlled register 593 may be omitted, and a fixed maximum iteration count may be provided as an input to comparator 594. Comparator 594 receives as inputs the outputs of pass counter 591 and software controlled register 593, and is configured to have a high output as long as the number of passes does not exceed the maximum iteration count, and a low output when the number of passes exceeds the maximum iteration count.

The outputs of comparators 514 and 560 are provided to an AND gate 561, which is configured to produce a high output when the outputs of comparators 514 and 560 are both high (i.e., when Inc_Peak is below UWM and Red_Avg is above LWM). The output of AND gate 561 is provided to another AND gate 562 and an OR gate 564.

AND gate 562 also receives the output of comparator 594 as an input. AND gate 562 enables the capture of Red_Avg by an average register 563, the input of which is connected to receive Red_Avg from average reducer 550. AND gate 562 is configured to have a high output when the outputs of both AND gate 561 and comparator 594 are high, such that capture of Red_Avg by average register 563 is only enabled if Inc_Peak is below UWM and Red_Avg is above LWM, and the number of passes does not exceed the maximum iteration count.

OR gate 564 also receives the output of 2nd pass block 592 as an input. Accordingly, the output of OR gate 564 is only high on the first pass if the output of AND gate 561 is high, and the output of OR gate 564 is always high for the second and subsequent passes. The output of OR gate 564 is provided as an input to AND gate 565, which also receives the Reduce Enable signal from AND gate 540 as an input. The output of AND gate 565 is provided to average selector 570, which is configured such that DS_Avg form downsampler 510 is provided to output 580 when the output of AND gate 565 is low, and the captured Red_Avg from average register 563 is provided to output 580 when the output of AND gate is high. Accordingly, average selector is prevented from passing Red_Avg to output 580 whenever the Reduce Enable signal is low, to avoid propagation of previously stored values of Red_Avg (i.e., Red_Avg values from a previously processed DS block). As one skilled in the art will appreciate, circuit 500 of FIG. 5 may also be adapted to employ an iterative technique similar to that shown in FIG. 5C.

Figure 6:
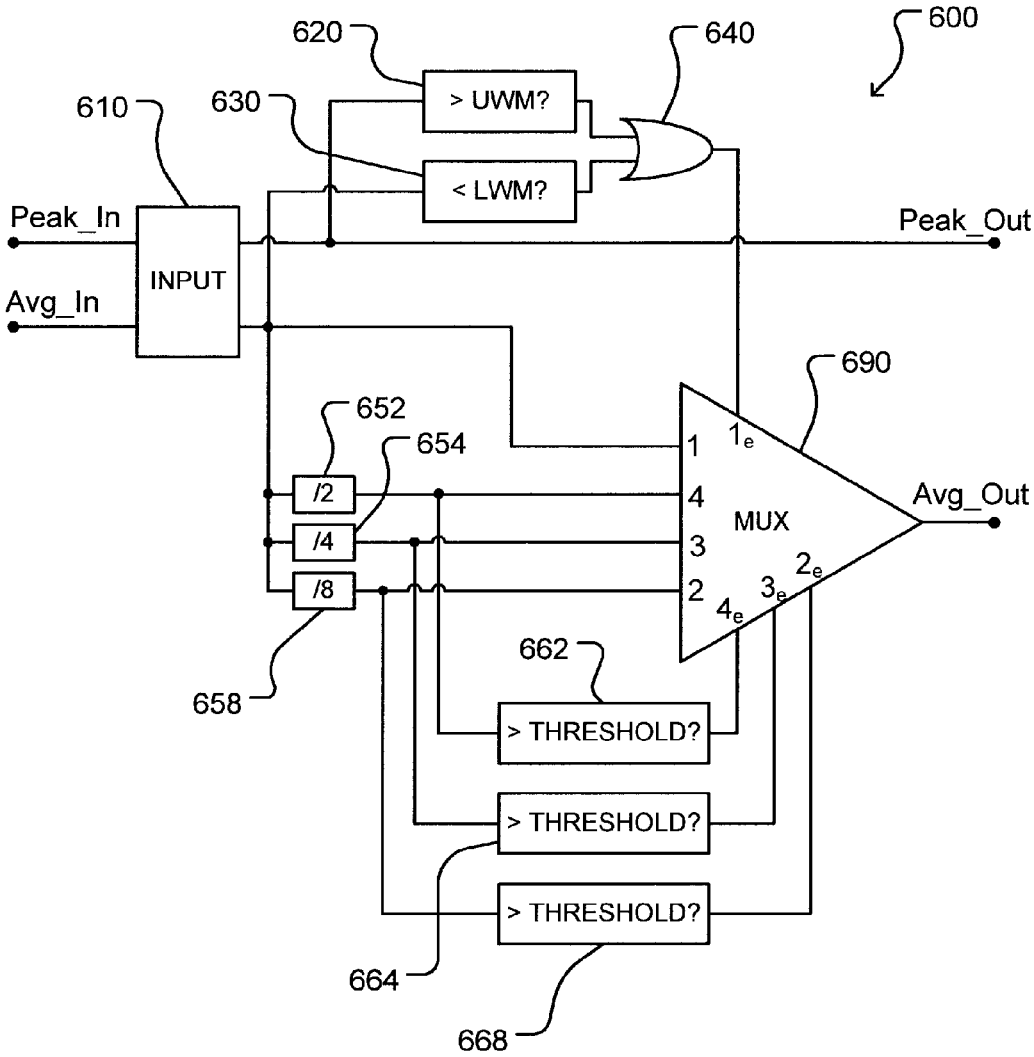

FIG. 6 shows an example circuit 600 according to one embodiment of the invention which may be included in a control system for a display for reducing power consumption of the display. An input 610 receives an input peak value (Peak_In) and an input average value (Avg_In) for a downsample block. Peak_In is provided to a comparator 620, and Avg_In is provided to a comparator 630. Comparator 620 is configured to produce a high output when Peak_In is greater than an upper watermark (UWM), and comparator 630 is configured to produce a high output when Avg_In is less than a lower watermark (LWM). Peak_In may also provided to an output as Peak_Out, if required for further downstream processing.

The outputs of comparators 620 and 630 are provided to an OR gate 640, which produces a high output when the output of either comparator 620 or comparator 630 (or both) is high. The output of OR gate 640 is provided as a first enable input to an average multiplexer 690, which is configured to output an average value (Avg_Out) for further downstream processing, as described below.

Avg_In is provided as a first average input to average multiplexer 690. Avg_In is also provided in parallel to a divide by two block 652, a divide by four block 654, and a divide by eight block 658, which are respectively configured to divide Avg_In by two, four and eight. The outputs of blocks 652, 654 and 658 are respectively provided to comparators 662, 664 and 668, which are configured to produce high outputs when the outputs of blocks 652, 654 and 658 are above a minimum average threshold. The output of comparator 668 is provided as a second enable input to average multiplexer 690, the output of comparator 664 is provided as a third enable input to average multiplexer 690, and the output of comparator 662 is provided as a fourth enable input to average multiplexer 690.

The outputs of blocks 652, 654 and 658 are also provided as inputs to average multiplexer 690, with the output of block 658 being provided as a second average input, the output of block 654 being provided as a third average input, and the output of block 652 being provided as a fourth average input. Average multiplexer 690 is configured to select one of the first through fourth average inputs as an output Avg_Out. If the first enable input is high, average multiplexer 690 selects the first average input (Avg_In) as Avg_Out, regardless of the signals present at the second through fourth enable inputs. If the first enable input is low and the second enable input is high, average multiplexer 690 selects the second average input (the output of divide by eight block 658) as Avg_Out, regardless of the signals present at the third and fourth enable inputs. If the first and second enable inputs are low and the third enable input is high, average multiplexer 690 selects the third average input (the output of divide by four block 654) as Avg_Out, regardless of the signals present at the fourth enable input. If the first through third enable inputs are low and the fourth enable input is high, average multiplexer 690 selects the fourth average input (the output of divide by two block 652) as Avg_Out. If all of the enable inputs are low, average multiplexer 690 selects the first average input (Avg_In) as Avg_Out.

Figure 6A:
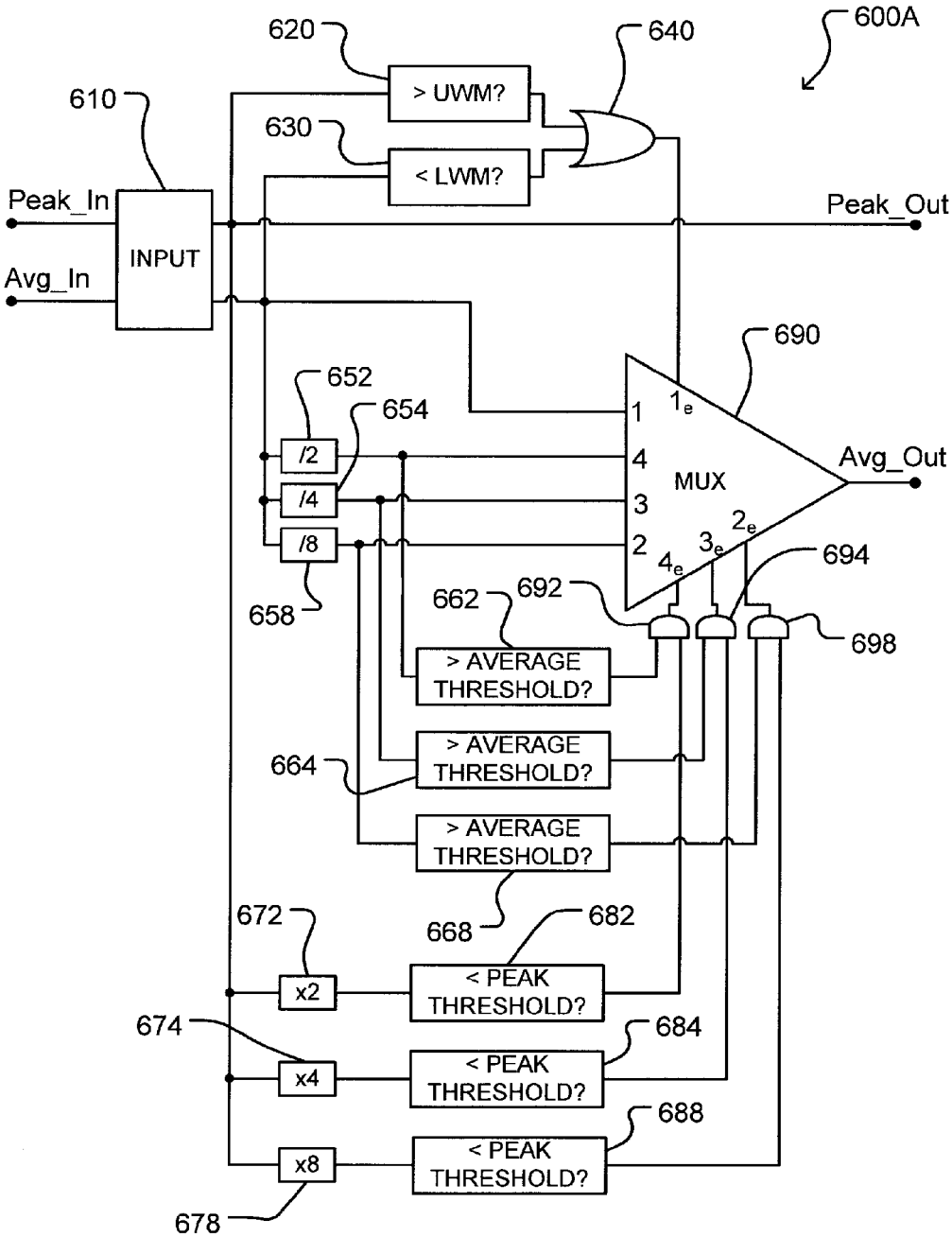

FIG. 6A shows another example circuit 600A which is similar to circuit 600 of FIG. 6. Circuit 600A differs from circuit 600 in that circuit 600A includes a multiply by two block 672, a multiply by four block 674, and a multiply by eight block 678 which each receive Peak_In as an input. The outputs of blocks 672, 674 and 678 are respectively provided to comparators 682, 684 and 688, which are configured to produce high outputs when the outputs of blocks 672, 674 and 678 are below a maximum peak threshold. The outputs of comparators 682, 684 and 688 are provided as inputs to AND gates 692, 694 and 698 respectively. AND gates 692, 694 and 698 also receive the outputs of comparators 662, 664 and 668, respectively, as outputs. The outputs of AND gates 692, 694 and 698 are respectively provided as the fourth, third, and second enable inputs to average multiplexer 690, which operates as described above.

As one in skilled in the art will appreciate, the example circuits shown in FIGS. 5, 5A, 5B, 5C 6 and 6A are for illustrative purposes only, and different circuit configurations may be provided in different embodiments. For example, in some embodiments, adjustment of image values is implemented by a FPGA or other configurable processing element.

From the above, one skilled in the art will appreciate that the invention may be implemented as:

displays which incorporate control systems;

video processing devices;

chips or processing units;

methods for displaying images; or methods for setting drive values for light emitters of a backlight.

Certain implementations of the invention comprise computer processors which execute software instructions which cause the processors to perform a method of the invention. For example, one or more processors in a display device may implement the methods of FIGS. 2 and 2A-F by executing software instructions in a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As one skilled in the art will appreciate, the example embodiments discussed above are for illustrative purposes only, and methods and systems according to embodiments of the invention may be implemented in any suitable device having appropriately configured processing hardware. Such processing hardware may include one or more programmable processors, programmable logic devices, such as programmable array logic ("PALs") and programmable logic arrays ("PLAs"), digital signal processors ("DSPs"), field programmable gate arrays ("FPGAs"), application specific integrated circuits ("ASICs"), large scale integrated circuits ("LSIs"), very large scale integrated circuits ("VLSIs") or the like.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

Accordingly the invention may suitably comprise, consist of, or consist essentially of, any of element (the various parts or features of the invention and their equivalents as described herein, currently existing, and/or as subsequently developed. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

Accordingly, the invention may be embodied in any of the forms described herein, including, but not limited to the following Enumerated Example Embodiments (EEEs) which described structure, features, and functionality of some portions of the present invention.

EEE1. A control system for a display comprising a backlight having a plurality of individually controllable light emitters configured to project light onto a front modulator having a plurality of individually controllable light transmission elements, the control system comprising:

an input configured to receive image data specifying a desired image at an initial resolution;

a downsampler configured to downsample the image data into a plurality of downsample blocks at a downsample spatial resolution lower than the initial spatial resolution and obtain one or more image values for each downsample block;

a backlight processing pipeline configured to determine driving levels for the light emitters of the backlight based on the image values for the downsample blocks;

a lightfield simulator configured to receive backlight driving data about the driving levels and to transform the backlight driving data into a backlight illumination pattern;

a front modulator processing pipeline configured to receive the image data from the input and the backlight illumination pattern from the lightfield simulator and to determine control levels for the light transmission elements of the front modulator; and, an image value adjuster configured to receive the image values for the downsample blocks from the downsampler and reduce image values of downsample blocks which meet adjustment criteria before providing the image values to the backlight processing pipeline.

EEE2. A control system according to EEE1 wherein the image values comprise a peak value and an average value for each downsample block.

EEE3. A control system according to EEE1 wherein the image values comprise a plurality of peak values and a plurality of average values for each downsample block.

EEE4. A control system according to EEE2 wherein the adjustment criteria are met when the peak value is below an upper watermark.

EEE5. A control system according to EEE4 wherein the adjustment criteria are met when the average value is above a lower watermark.

EEE6. A control system according to EEE5 wherein image values and upper and lower watermarks are represented using N bits, where N is a positive integer.

EEE7. A control system according to EEE6 wherein the upper watermark has a value of $2^{N-1}-1$.

EEE8. A control system according to EEE7 wherein the lower watermark has a value of $2^{M-1}$, where M is a positive integer less than N−1.

EEE9. A control system according to EEE1 comprising an image filtering element connected to filter the image values output by the image value adjuster.

EEE10. A control system according to EEE2 wherein the image value adjuster is configured to generate a reduced average value for each downsample block which meets the adjustment criteria.

EEE11. A control system according to EEE10 wherein the image value adjuster generates the reduced average value by dividing the average value by $2^n$, where n is a positive integer.

EEE12. A control system according to EEE10 wherein the image value adjuster generates the reduced average value by reducing the average value logarithmically.

EEE13. A control system according to EEE10 wherein the image value adjuster generates the reduced average value by calculating a scaled average value based on a ratio of the peak value to the upper watermark.

EEE14. A control system according to EEE13 wherein the image value adjuster adds an offset to the scaled average value.

EEE15. A control system according to EEE10 wherein the image value adjuster is configured to compare the reduced average value to a minimum average threshold and provide an original average value to the backlight processing pipeline when the reduced average value is below the minimum average threshold.

EEE16. A control system according to EEE15 wherein the image value adjuster is configured to generate an increased peak value for each downsample block which meets the adjustment criteria.

EEE17. A control system according to EEE16 wherein the image value adjuster is configured to compare the increased peak value to a maximum peak threshold and provide the original average value to the backlight processing pipeline when the increased peak value is above the maximum peak threshold.

EEE18. A control system according to EEE15 wherein the image value adjuster is configured to generate the reduced average value by iteratively reducing the average value until a current reduced average value is below the minimum average threshold and selecting a previous reduced average value for providing to the backlight processing pipeline.

EEE19. A method of reducing power consumption in a display comprising a backlight having a plurality of individually controllable light emitters configured to project light onto a front modulator having a plurality of individually controllable light transmission elements, the method comprising:

receiving image data specifying a plurality of pixel values at an initial spatial resolution;

downsampling the image data into a plurality of downsample blocks at a downsample spatial resolution lower than the initial spatial resolution to obtain one or more image values for each downsample block;

selectively reducing image values of downsample blocks which meet adjustment criteria to generate adjusted image values; and, providing the adjusted image values to a backlight processing pipeline configured to drive the individually controllable light emitters based on the adjusted image values.

EEE20. A method according to claim 19 wherein the image values comprise a peak value and an average value for each downsample block.

EEE21. A method according to claim 19 wherein the image values comprise a plurality of peak values and a plurality of average values for each downsample block.

EEE22. A method according to EEE20 wherein the adjustment criteria are met when the peak value is below an upper watermark.

EEE23. A method according to EEE22 wherein the adjustment criteria are met when the average value is above a lower watermark.

EEE24. A method according to EEE23 wherein image values and upper and lower watermarks are represented using N bits, where N is a positive integer.

EEE25. A method according to EEE24 wherein the upper watermark has a value of $2^{N-1}-1$.

EEE26. A method according to EEE25 wherein the lower watermark has a value of $2^{M-1}$, where M is a positive integer less than N−1.

EEE27. A method according to EEE19 comprising filtering the adjusted image values before determining driving levels for the light emitters in the backlight processing pipeline.

EEE28. A method according to EEE20 comprising generating a reduced average value for each downsample block which meets the adjustment criteria.

EEE29. A method according to EEE28 comprising generating the reduced average value by dividing the average value by $2^n$, where n is a positive integer.

EEE30. A method according to EEE28 comprising generating the reduced average value by reducing the average value logarithmically.

EEE31. A method according to EEE28 comprising generating the reduced average value by calculating a scaled average value based on a ratio of the peak value to the upper watermark.

EEE32. A method according to EEE31 comprising adding an offset to the scaled average value.

EEE33. A method according to EEE28 comprising comparing the reduced average value to a minimum average threshold and providing an original average value to the backlight processing pipeline when the reduced average value is below the minimum average threshold.

EEE34. A method according to EEE33 comprising generating an increased peak value for each downsample block which meets the adjustment criteria.

EEE35. A method according to EEE34 comprising comparing the increased peak value to a maximum peak threshold and providing the original average value to the backlight processing pipeline when the increased peak value is above the maximum peak threshold.

EEE36. A method according to EEE33 comprising generating the reduced average value by iteratively reducing the average value until a current reduced average value is below the minimum average threshold and selecting a previous reduced average value for providing to the backlight processing pipeline.

The invention claimed is:

1. A control system for a display comprising a backlight having a plurality of individually controllable light emitters configured to project light onto a front modulator having a plurality of individually controllable light transmission elements, the control system comprising:

an input configured to receive image data specifying a desired image at an initial resolution;

a downsampler configured to downsample the image data into a plurality of downsample blocks at a downsample spatial resolution lower than the initial spatial resolution and obtain one or more image values for each downsample block;

wherein the image values comprise a peak value and an average value for each downsample block;

an image value adjuster configured to receive the image values for the downsample blocks from the downsampler and reduce the average values of the image values for each downsample block which meets adjustment criteria before providing the reduced average values of the image values to the backlight processing pipeline;

a backlight processing pipeline configured to determine driving levels for the light emitters of the backlight based on the reduced average values of the image values output from the image value adjuster, the reduced average values of the image values resulting in a reduction in the power consumption of the light emitters of the backlight;

a lightfield simulator configured to receive backlight driving data about the driving levels and to transform the backlight driving data into a backlight illumination pattern; and, a front modulator processing pipeline configured to receive the image data from the input and the backlight illumination pattern from the lightfield simulator and to determine control levels for the light transmission elements of the front modulator;

wherein the adjustment criteria are met when the peak value is below an upper watermark and the average value is above a lower watermark;

wherein image values and upper and lower watermarks are represented using N bits, where N is a positive integer;

wherein the upper watermark has a value of $2^{N-1}-1$, and the lower watermark has a value of $2^{M-1}$, where M is a positive integer less than N−1.

2. A control system according to claim 1 wherein the image values comprise a plurality of peak values and a plurality of average values for each downsample block.

3. A control system according to claim 1 comprising an image filtering element connected to filter the image values output by the image value adjuster.

4. A control system according to claim 1 wherein the image value adjuster generates the reduced average value by dividing the average value by $2^n$, where n is a positive integer.

5. A control system according to claim 1 wherein the image value adjuster generates the reduced average value by reducing the average value logarithmically.

6. A control system according to claim 1 wherein the image value adjuster generates the reduced average value by calculating a scaled average value based on a ratio of the peak value to the upper watermark.

7. A control system according to claim 6 wherein the image value adjuster adds an offset to the scaled average value.

8. A control system according to claim 1 wherein the image value adjuster is configured to compare the reduced average value to a minimum average threshold and provide an original average value to the backlight processing pipeline when the reduced average value is below the minimum average threshold.

9. A control system according to claim 8 wherein the image value adjuster is configured to generate the reduced average value by iteratively reducing the average value until a current reduced average value is below the minimum average threshold and selecting a previous reduced average value for providing to the backlight processing pipeline.

* * * * *